US010978809B2

(12) United States Patent
Visentin et al.

(10) Patent No.: US 10,978,809 B2
(45) Date of Patent: Apr. 13, 2021

(54) REFLECTOR HAVING AN ELECTRONIC CIRCUIT AND ANTENNA DEVICE HAVING A REFLECTOR

(71) Applicant: Fraunhofer-Gesellschaft zur Förderung der angewandten Forschung e.V., Munich (DE)

(72) Inventors: Tristan Visentin, Stuttgart (DE); Wilhelm Keusgen, Berlin (DE); Richard Weiler, Berlin (DE)

(73) Assignee: Fraunhofer-Gesellschaft zur Förderung der angewandten Forschung e.V.

( * ) Notice: Subject to any disclaimer, the term of this patent is extended or adjusted under 35 U.S.C. 154(b) by 520 days.

(21) Appl. No.: 15/683,352

(22) Filed: Aug. 22, 2017

(65) Prior Publication Data

US 2017/0373401 A1 Dec. 28, 2017

Related U.S. Application Data

(63) Continuation of application No. PCT/EP2016/053674, filed on Feb. 22, 2016.

(30) Foreign Application Priority Data

Feb. 24, 2015 (EP) ..... 15156378

(51) Int. Cl.
*H01Q 15/14* (2006.01)
*H01Q 3/46* (2006.01)
(Continued)

(52) U.S. Cl.
CPC ..... *H01Q 15/148* (2013.01); *H01Q 3/46* (2013.01); *H01Q 19/19* (2013.01); *H01Q 23/00* (2013.01); *H01Q 1/40* (2013.01)

(58) Field of Classification Search
CPC ..... H01Q 3/46; H01Q 15/148; H01Q 23/00; H01Q 19/19
See application file for complete search history.

(56) References Cited

U.S. PATENT DOCUMENTS 3,254,342 A * 5/1966 Miller ..... G02B 26/0825 343/781 R
3,877,032 A * 4/1975 Rosa ..... H01Q 3/2658 343/778
(Continued)

FOREIGN PATENT DOCUMENTS

CN 1943075 A 4/2007
CN 101032055 A 9/2007
(Continued)

OTHER PUBLICATIONS

International Search Report dated May 17, 2016 issued in corresponding PCT App. No. PCT/EP2016/053674 (3 pages).
(Continued)

*Primary Examiner* — Ab Salam Alkassim, Jr.
(74) *Attorney, Agent, or Firm* — Haynes and Boone, LLP

(57) ABSTRACT

A reflector includes a substrate, a plurality of reflector structures arranged on or in the substrate and configured to reflect an incident electromagnetic wave. The reflector further includes an electronic circuit that is arranged at, on or in the substrate and configured to control an antenna when the antenna is connected to the electronic circuit.

18 Claims, 15 Drawing Sheets

(51) Int. Cl.

| | |
|---|---|
| ***H01Q 23/00*** | (2006.01) |
| ***H01Q 19/19*** | (2006.01) |
| *H01Q 1/40* | (2006.01) |

(56) References Cited

U.S. PATENT DOCUMENTS 4,142,190 A * 2/1979 Kerr ..... H01Q 19/12 343/700 MS
4,462,034 A * 7/1984 Betsudan ..... H01Q 3/245 343/761
4,684,952 A * 8/1987 Munson ..... H01Q 21/065 342/368
5,451,969 A * 9/1995 Toth ..... H01Q 19/19 343/700 MS
6,020,853 A * 2/2000 Richards ..... H01Q 1/38 343/700 MS
6,081,234 A * 6/2000 Huang ..... H01Q 3/14 343/700 MS
6,150,991 A * 11/2000 Hulderman ..... H01Q 1/3233 343/755
6,281,852 B1 * 8/2001 Amarillas ..... H01Q 19/065 343/725
6,384,787 B1 * 5/2002 Kim ..... H01P 1/184 343/700 MS
6,597,327 B2 * 7/2003 Kanamaluru ..... H01Q 1/38 343/753
6,642,889 B1 * 11/2003 McGrath ..... H01Q 1/38 343/700 MS
6,744,411 B1 6/2004 Osterhues et al.
6,774,851 B1 * 8/2004 Cuhaci ..... H01Q 3/46 343/700 MS
7,161,539 B2 * 1/2007 Chang ..... H01Q 9/0414 343/700 MS
7,224,314 B2 * 5/2007 Lee ..... H01Q 3/46 343/700 MS
7,439,913 B2 * 10/2008 Chang ..... H01Q 1/38 343/700 MS
7,791,552 B1 * 9/2010 Romanofsky ..... H01Q 15/148 343/700 MS
9,450,308 B1 * 9/2016 Lewis, Jr. ..... H01Q 13/025
9,831,561 B2 * 11/2017 Byun ..... H01Q 15/148
10,276,929 B2 * 4/2019 Meyer ..... H01Q 1/3283
2001/0020914 A1 * 9/2001 Roederer ..... H01Q 3/46 342/371
2001/0028328 A1 * 10/2001 Stjernman ..... H01Q 3/46 343/761
2004/0178966 A1 * 9/2004 Rawnick ..... H01Q 19/12 343/912
2004/0196192 A1 * 10/2004 Boyd ..... H01Q 1/28 343/700 MS
2004/0196193 A1 * 10/2004 Brown ..... H01Q 21/0018 343/700 MS
2004/0227691 A1 * 11/2004 Rawnick ..... H01Q 19/021 343/912
2006/0097940 A1 * 5/2006 Shimawaki ..... H01Q 3/26 343/761
2007/0159405 A1 * 7/2007 Eom ..... G01S 3/42 343/757
2007/0273599 A1 11/2007 Haziza
2008/0042917 A1 * 2/2008 Seki ..... H01Q 1/2283 343/767
2009/0079645 A1 * 3/2009 Sotelo ..... H01Q 3/46 343/755
2009/0102716 A1 * 4/2009 Sego ..... G01S 7/003 342/377
2010/0052987 A1 * 3/2010 Weinstein ..... H01Q 19/19 342/372
2010/0134357 A1 * 6/2010 Yang ..... H01Q 1/12 343/700 MS
2011/0012801 A1 * 1/2011 Monte ..... H01Q 1/288 343/762
2011/0241956 A1 * 10/2011 Byun ..... H01Q 3/46 343/781 CA
2012/0013516 A1 * 1/2012 Ahn ..... H01Q 19/19 343/779
2012/0127037 A1 * 5/2012 Fujiwara ..... H01Q 9/0407 343/700 MS
2012/0162010 A1 * 6/2012 Georgiadis ..... E02D 29/14 342/374
2013/0241770 A1 9/2013 Legay
2014/0118220 A1 * 5/2014 Ley ..... H01Q 19/19 343/912
2017/0077600 A1 * 3/2017 Maltsev ..... H01Q 1/246

FOREIGN PATENT DOCUMENTS

| | | | |
|---|---|---|---|
| CN | 102299418 | A | 12/2011 |
| CN | 102509894 | A | 6/2012 |
| CN | 102856662 | A | 1/2013 |
| CN | 104332717 | A | 2/2015 |
| JP | 2006-203602 | A | 8/2006 |
| JP | 2007-528663 | A | 10/2007 |
| JP | 2007-528663 | T | 10/2007 |
| JP | 2009-236659 | A | 10/2009 |
| JP | 2012-509001 | A | 4/2012 |
| JP | 2012-509001 | T | 4/2012 |
| JP | 2012-249004 | A | 12/2012 |
| WO | WO2005/031921 | A1 | 4/2005 |
| WO | WO 2006122040 | A2 | 11/2006 |

OTHER PUBLICATIONS

International Preliminary Report on Patentability dated Aug. 29, 2017 issued in corresponding PCT App. No. PCT/EP2016/053674 (16 pages).
Office Action in the parallel European patent application No. 15156378.0 dated Jul. 27, 2018 (8 pages with English translation).
Office Action dated Sep. 25, 2018 issued in the parallel JP patent application No. 2017-544888 (9 pages with English translation).
Office Action dated Jun. 14, 2018 issued in parallel Canadian patent application No. 2,976,830 (3 pages).
D. M, Pozar et al.: "Design of Millimeter Wave Microstrip Refelectarrays"; IEEE Transaction on Antennas and Propagation; vol. 45; No. 2; Feb. 1997; XP011002907.
R. Leberer et al.: "A dual planar reflectarray with synthesized phase and amplitude distribution"; IEEE Transaction on Antennas and Propagation; vol. 53; No. 11; Nov. 2005; XP001512751.
Office Action dated Oct. 31, 2019 issued in the parallel Chinese patent application No. 201680023482.X (26 pages).
Office Action dated Jun. 30, 2020 issued in the parallel Japanese patent application No. 2017-544888 (31 pages).
Office Action dated Feb. 28, 2020 received in the parallel European patent application No. 16705555.7 (6 pages).
Office Action dated Jul. 15, 2020 issued in the parallel Japanese patent application No. 2019-131034 (14 pages).
David M Pozar, Design of Millimeter Wave Microstrip Reflectarrays, IEEE Transactions on Antennas and Propagation, US, IEEE Service Center, Feb. 1997, vol. 45, No. 2, p. 287, pp. 289 to 290.
Leberer R, A dual planar reflectarray with synthesized phase and amplitude distribution, IEEE Transactions on Antennas and Propagation, USA, IEEE Service Center, Nov. 2005, vol. 53, No. 11, p. 3534.

* cited by examiner

REFLECTOR HAVING AN ELECTRONIC CIRCUIT AND ANTENNA DEVICE HAVING A REFLECTOR

CROSS-REFERENCE TO RELATED APPLICATIONS

This application is a continuation of co-pending International Application No. PCT/EP2016/053674, filed Feb. 22, 2016, which is incorporated herein by reference in its entirety, and additionally claims priority from European Application No. EP 15156378.0, filed Feb. 24, 2015, which is also incorporated herein by reference in its entirety.

The present invention relates to a reflector having an electronic circuit, which can be used, for example, for reflecting an incident electromagnetic wave and to an antenna device. Further, the present invention relates to a double reflector system with active electronics integrated in the main reflector.

BACKGROUND OF THE INVENTION

Decoupled non-integrated solutions exist, where directional antenna, data processing and radio front end (i.e., electronic circuits) represent separate modules that are connected to one another. This connection is established via coaxial connections, conductive traces from the outputs of the electronic components, such as amplifiers, junctions from conductive traces to waveguides, bond wire connections or the same. Disadvantages thereof are the physical size of the overall system as well as losses as regards to weight and efficiency of the antenna system, such as losses in the junctions from electronics to antenna, matching losses, etc.

Integrated solutions realizing the electronics of data processing, radio front end and the transmitting and receiving antenna (feeding antenna), respectively, together on one printed circuit board are applied in so-called PIFAs (Planar Inverted F Antenna) or patch antennas based on printed circuit boards or on-chip antennas that radiate out of a chip housing. These antennas have a broad radiation, develop no high directivity and are hence unsuitable for radio relay applications. Phased array antennas also use the principle of integrated electronics in combination with radiating antenna elements on a printed circuit board but do not use reflector components for increasing directivity but use the combined radiation of many active antenna elements (e.g., patch antennas on the printed circuit board) in order to achieve directivity. This involves active electronics, phase shifters and a complex control network of the individual antenna elements.

In a different approach, so-called reflect array (e.g., an array of reflector elements) printed circuit boards with layers of integrated solar cells are used that are needed for energy generation, e.g., on a satellite. This is effected on the basis of passive electronics.

FIG. 14 shows a schematic illustration of a reflect array 102 including a substrate 104 and a plurality of scattering elements 106. A feeding antenna 108 arranged spaced apart from the reflect array 102 can emit a radio signal in the direction of the reflect array 102, wherein the radio signal is reflected by the reflect array 102.

The main reflector (reflect array 102) as well as optional sub-reflectors (further reflectors) can be implemented based on printed circuit boards with reflective metallic individual elements on a substrate with underlying metallic ground plane, i.e., reflect arrays. The reflective elements on the printed circuit boards have the effect of impressing a desired phase function on the incident radiation in order to model the function of a physically curved main and sub-reflector, respectively.

Accordingly, a concept for antenna reflectors and/or antenna devices allowing efficient operation of the same would be desirable.

SUMMARY

According to an embodiment, a reflector may have: a substrate; a plurality of reflector structures arranged on or in the substrate and configured to reflect an incident electromagnetic wave; and an electronic circuit arranged on or in the substrate and configured to control an antenna when the antenna is connected to the electronic circuit.

According to another embodiment, an antenna device may have: an inventive reflector; an antenna; and a sub-reflector that is configured to reflect the electromagnetic wave emitted by the antenna at least partly in the direction of the plurality of reflector structures, such that the electromagnetic wave reflected by the sub-reflector is directed in the direction of the plurality of reflector structures and reflected again by the same; wherein the antenna is connected to the electronic circuit and configured to generate the electromagnetic wave based on a control of the electronic circuit and to emit the same in a direction of the sub-reflector.

The core idea of the present invention is the finding that an electronic circuit for controlling an antenna can be arranged on or in a substrate of a reflector, such that the circuit for controlling the antenna and the reflector can be implemented with low-loss (possibly fixed) electric connections, such that a lossy mechanically detachable coupling of the two elements can be omitted. In that way, electric losses can be reduced, which allows efficient operation of the reflector.

According to one embodiment, a reflector includes a substrate and a plurality of reflector structures arranged on or in the substrate. The reflector structures are configured to reflect an incident electromagnetic wave. An electronic circuit is arranged on or in the substrate and is configured to control an antenna when the antenna is connected to the electronic circuit. It is an advantage of this implementation that power losses between data processing and radio front end can be low, such as when the electronic circuit includes data processing and radio front end. The reflector can be realized in a compact manner, i.e., with a small installation space and possibly with little weight.

According to a further embodiment, the plurality of reflector structures are configured to reflect the incident electromagnetic wave such that the reflected electromagnetic wave experiences beam focusing due to the reflection at the plurality of reflector structures. It is an advantage that directivity (i.e., collimated or at least less scattered electromagnetic wave) of the radio signal to be transmitted is obtained by means of the reflector structures such that signal transmission necessitating little transmitting power and/or having a high transmission path is enabled by means of the reflector, which results in an operating efficiency that is improved further.

According to a further embodiment, the plurality of reflector structures are arranged in at least two differing substrate planes. The substrate planes are arranged parallel to a substrate surface arranged facing a direction in which the electromagnetic wave is reflected. It is an advantage that tolerance robustness of the reflector is obtained by means of the two or more substrate planes. Reflector structures arranged on different substrate planes can be positioned relative to one another by means of a relative position of the substrate planes. Further, components of the electronic circuit can be positioned relative to the substrate planes such that robustness with respect to position shifts is obtained.

According to a further embodiment, at least one reflector structure of the plurality of reflector structures includes a plurality (two or more) dipole structures. It is advantageous that based on the reflectors structures and in connection with the electronic circuits, a plurality of transmission channels can be used or implemented, such as one transmission channel per dipole structure, one receive channel per dipole structure and/or simultaneous transmission and receive operation of the electronic circuit and/or a connected antenna.

According to further embodiments, the reflector includes a radome structure arranged with respect to the plurality of reflector structures and configured to at least partly reduce a mechanical or chemical influence of an environment of the plurality of reflector structures on the plurality of reflector structures. The radome structure includes, at least in areas, an electrically conductive structure that is configured to reflect the electromagnetic wave, wherein the electrically conductive structure is arranged with respect to the plurality of reflector structures such that the electromagnetic wave reflected by the electrically conductive structure is directed in the direction of the plurality of reflector structures and reflected again by the same. Simply put, the electrically conductive structure can be arranged as a sub-reflector with respect to a reflector used as a main reflector. It is an advantage of this embodiment that low sensitivity of the reflector with respect to external influences is obtained and the reflector can be used as Cassegrain reflector structure or as Gregorian reflector structure.

According to a further embodiment, an antenna is arranged on or in the substrate, which is connected to the electronic circuit and configured to generate the electromagnetic wave based on a control of the electronic circuit. It is an advantage of this embodiment that power losses between the electronic circuit and the antenna are also reduced, such that even more efficient operation of the reflector is enabled. A further advantage is that a compact assembly can be realized where the reflector and the antenna are implemented adjacent to one another or even in an integrated manner.

According to a further embodiment, an antenna device includes an above-described reflector, a sub-reflector that is configured to reflect the electromagnetic wave emitted by the antenna at least partly in the direction of the plurality of reflector structures, such that the electromagnetic wave reflected by the sub-reflector is directed in the direction of the plurality of reflector structures and reflected again by the same. Further, the antenna device includes an antenna that is connected to the electronic circuit and configured to generate the electromagnetic wave based on a control of the electronic circuit and to emit the same in a direction of the sub-reflector. It is an advantage of this embodiment that an integrated design of the antenna and/or an efficient operation of the antenna device are enabled.

According to an embodiment, the reflector structures and the sub-reflector comprise a Cassegrain configuration or a Gregorian configuration. It is advantageous that high directivity of the antenna device can be obtained such that little transmission power is necessitated and/or a great transmission range is obtained.

According to a further embodiment, the antenna is configured as surface mounted device (SMD). It is an advantage that the antenna device comprises a high functional integration density as overall structure and the antenna device can be implemented with a small installation space and/or little weight.

According to a further embodiment, an axial relative position of the sub-reflector with respect to the reflector is variable along an axial direction parallel to a surface normal of the substrate. It is advantageous that a radiation characteristic of the antenna device, such as focusing of the incident electromagnetic wave, is adjustable.

According to a further embodiment, a lateral relative position of the sub-reflector with respect to the reflector is variable along a lateral direction perpendicular to a surface normal of the substrate or an inclination of the main reflector or sub-reflector with respect to a surface of the substrate of the reflector. It is an advantage of this embodiment that a radiation direction of the antenna device can be varied without changing a phase function of the plurality of reflector structures.

According to a further embodiment, the antenna includes a plurality of antenna elements, wherein a first subset of the antenna elements is configured to generate the electromagnetic wave with a first polarization direction and wherein a second subset of the antenna elements is configured to generate the electromagnetic wave with a second polarization direction. A first subset of the plurality of reflector structures is configured to reflect the electromagnetic wave with a first degree of reflection when the electromagnetic wave comprises the first polarization direction and to reflect the same with a second degree of reflection when the electromagnetic wave comprises the second polarization. A second subset of the plurality of reflector structures is configured to reflect the electromagnetic wave with a third degree of reflection when the electromagnetic wave comprises the second polarization direction and to reflect the same with a fourth degree of reflection when the electromagnetic wave comprises the first polarization. The first degree of reflection and the third degree of reflection have a greater value than the second degree of reflection and the fourth degree of reflection. It is an advantage that differing signals having differing polarizations can be transmitted and/or received simultaneously and in that way the antenna device has a high transmission efficiency.

According to an embodiment, the antenna is configured to direct an electromagnetic wave emitted in the direction of the antenna device and received by the antenna device to the electric circuit or a further electric circuit. It is an advantage that a transmit function, receive function as well as generating the electromagnetic wave can be implemented in an integrated manner as a function of one device.

According to a further embodiment, the antenna device includes a plurality of antennas and a plurality of sub-reflectors, wherein each sub-reflector is allocated to one antenna. It is advantageous that the reflector can be arranged in a shared manner with regard to the plurality of antennas and the plurality of sub-reflectors such that high compactness of a multi-antenna device is obtained.

BRIEF DESCRIPTION OF THE DRAWINGS

Embodiments of the present invention will be detailed subsequently referring to the appended drawings, in which.

DETAILED DESCRIPTION OF THE INVENTION

Before embodiments of the present invention will be discussed in more detail below based on the drawings, it should be noted that identical, functionally equal or equal elements, objects and/or structures are provided with the same reference numbers in the different figures, such that the description of these elements illustrated in different embodiments are inter-exchangeable or inter-applicable.

Figure 1:
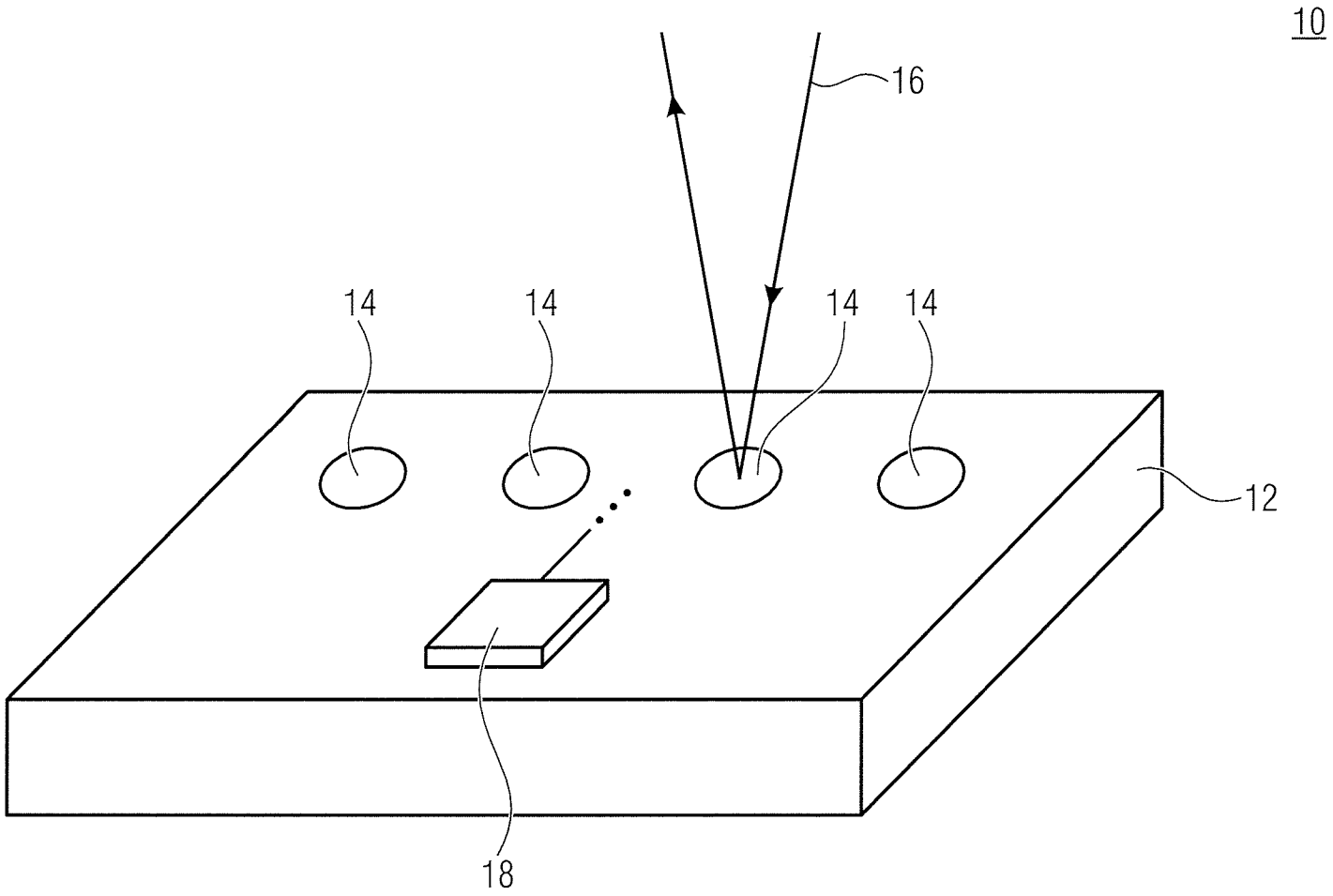
FIG. 1 is a schematic block diagram of a reflector according to an embodiment.

FIG. 1 shows a schematic block diagram of a reflector 10. The reflector 10 includes a substrate 12 and a plurality of reflector structures 14 that are arranged on a surface of the substrate 12. The plurality of reflector structures 14 are configured to reflect an incident electromagnetic wave 16 (radio signal). Further, the reflector 10 includes an electronic circuit 18 that is arranged on the same side of the substrate as the plurality of reflector structures. The electronic circuit 18 is configured to control an antenna (not shown) when the antenna is connected to the electronic circuit. The antenna can, for example, be the antenna that generates and emits the electromagnetic wave 16, respectively.

The substrate 12 can be any carrier material, such as low-loss HF materials (HF=high frequency). Low-loss HF materials can be obtained based on PTFE composite materials (PTFE=polytetrafluorethylene). Alternatively or additionally, the substrate can be at least partly a silicon substrate (wafer or parts thereof) or a printed circuit board (PCB). The substrate 12 can comprise one or several layers (sheets) that are connected to one another or separated by intermediate sheets. The intermediate sheets can, for example, be metallic sheets that allow shielding from the electromagnetic wave 16 and/or supply electronic components with a supply or reference potential (ground). The intermediate sheets can also be air sheets, i.e. two layers of the substrate can be connected to one another by means of spacers. It is also possible that different layers 22*a* and 22*b* or 22*b* and 22*c* comprise an intermediate air sheet and are, for example, screwed together or the same. The intermediate air layers can be used for accommodating reflector structures or can act as reflector structures.

The plurality of reflector structures 14 are exemplarily arranged on a first main side of the substrate 12, i.e. on a side of the substrate 12 arranged facing the incident electromagnetic wave 16. While the electronic circuit 18 is described such that the same is arranged on the same side as the plurality of reflector structures 14, the electronic circuit can also be arranged completely or partly (such as in the form of partial circuits) on a different, for example, opposite side of the substrate 12. The plurality of reflector structures 14 and/or the electronic circuit 18 can also be arranged completely or partly on or in the substrate 12, for example when the substrate 12 is a multilayered structure. Simply put, regarding one or all reflector structures 14 and/or the electronic circuit 18, a further layer of the substrate 12 can be arranged, such that the related reflector structure and/or the electric circuit 18 are covered by the further layer.

The reflector structures 14 can comprise electrically conductive materials, such as metals or semiconductors. A surface geometry of the plurality of reflector structures can be selected such that the respective surface shape of the reflector structures 14 and/or their relative position to one another impresses a phase function on the incident electromagnetic wave 16. The electrically conductive material can, for example, be platinum, gold, silver, aluminum, copper, a (doped) semiconductor or the same. The plurality of reflector structures can be arranged on the substrate 12, for example by means of an adhesive, pressure or sputtering method or by means of vapor deposition. Alternatively, the plurality of reflector structures can be formed in the form of island structures in a PCB by etching or milling. At least one reflector structure can be arranged by means of chemical gold plating or by means or vapor deposition.

A phase function impressed on the electromagnetic wave 16 by the reflector structures 14 can be implemented such that the electromagnetic wave 16 is focused by the reflection or is at least reflected in a less scattered manner by the reflector 10. The impressed phase function can model a curvature of the reflector 10, such as convex or concave. Here, the plurality of reflector structures are matched to one another based on the phase function such that the electromagnetic wave 16 is reflected locally different (direction, polarization, etc.) across the planer distribution and configuration of the reflector structures 14 such that the phase function is impressed on the electromagnetic wave 16. Further, beam contour and contoured beam, respectively, can be obtained by the phase function.

Figure 2:
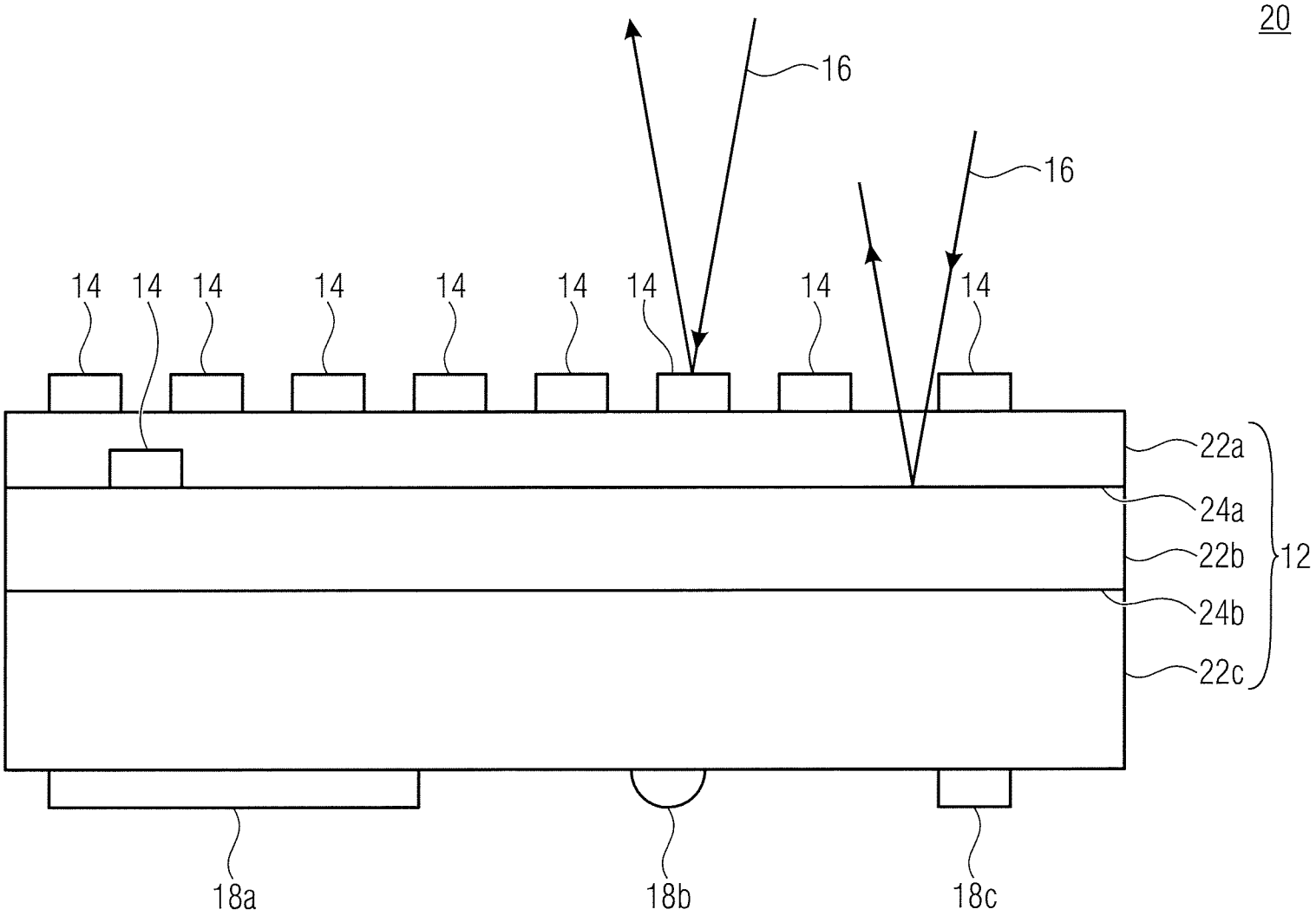
FIG. 2 is a schematic side sectional view of a reflector with a substrate including a multilayered board according to an embodiment.

FIG. 2 shows a schematic side sectional view of a reflector 20. The reflector 20 includes the substrate 12, wherein the substrate 12 includes a printed circuit board or is implemented as multilayered printed circuit board. The substrate 12 includes a first layer 22*a*, a second layer 22*b* and a third layer 22*c* that together form parts of a stack, wherein a first at least partly electrically conductive sheet 24*a* is arranged between the first layer 22*a* and the second layer 22*b*, and a second at least partly electrically conductive sheet 24*b* is arranged between the second layer 22*b* and the third layer 22*c*. The sheets 22*a*, 22*b* and/or 22*c* can include, for example, an epoxy material, a semiconductor material and/or a glass fiber material such as FR-4, Kapton, or the same, that can be adhered to one another. For improving clarity, but without any limiting effect, the stack of the substrate 12 is described such that the plurality of reflector structures 14 are arranged at a top end of the substrate 12 and the electronic circuit including electronic partial circuits 18*a-c* is arranged at a bottom end of the stack. It is obvious that depending on the orientation of the reflector 20 in space the designations "top" and "bottom", respectively, can be replaced by any other designation. Alternatively, a multilayered substrate can also include merely one layer and one conductive sheet.

The conductive sheets 24*a* and 24*b* can, for example, include metallic materials and can be used and contacted, respectively, as ground plane. Above that, the conductive sheets 24*a* and/or 24*b* allow a (possibly complete) reflection of the electromagnetic wave 16. This can relate to portions of the electromagnetic wave 16 that are not reflected by the reflector structures 14 and that enter the substrate 12. An arrangement of the electronic circuit and the partial circuits 18*a*, 18*b* and/or 18*c*, respectively, on one side of the conductive sheets 24*a* and/or 24*b* that is facing away from the incident electromagnetic wave 16 allows shielding of the electronic partial circuits 18*a-c* from the electromagnetic wave. During operation, this offers advantages in particular with regard to low electromagnetic coupling of the electromagnetic wave 16 in circuit structures which would lead to an adverse effect on the functionality of the electronic circuit. Thus, the shielding allows an increased electromagnetic compatibility (EMC) of the reflector 20. Further, the arrangement of the electronic partial circuits 18*a-c* on a different side than the plurality of reflector structures 14 allows increased space utilization of the top side of the stack by the reflector structures 14 since no space is needed for the electronic circuit.

At least one reflector structure 14 is arranged in a substrate plane differing from the top side of the substrate 12, for example as a structure arranged on or in the metallic sheet 24*a*. The metallic sheet 24*a* can be structured, for example. This allows an increased (area) density of the reflector structures 14 with regard to the electromagnetic wave 16, such that the reflected portion of the electromagnetic wave 16 provided with a phase function is increased. This allows during operation that a lower portion of the electromagnetic wave 16 couples into the electrically conductive sheet. Alternatively or additionally, an increased or the entire portion of the electromagnetic wave 16 can be provided with a phase function. Compared to the incident electromagnetic wave 16, the phase function of the reflected electromagnetic wave can have an increased measure of linearity which results in an increased tolerance robustness.

Alternatively, it is also possible that one or several electronic partial circuits 18*a-c* are arranged facing the electromagnetic wave 16 on the first layer 22*a*. Alternatively or additionally, one or several electronic partial circuits 18*a-c* can be arranged in the substrate 12, for example on the second layer 22*b* or the first or second electrically conductive sheet 24*a* or 24*b*.

Below the ground plane 24*a* is a further sheet (second layer 22*b*) that can have an electric function or merely serves for the stability of the printed circuit board. Below that is a further ground plane 24*b* that can form, for example galvanically separated from the top ground plane 24*a*, the ground plane for the substrate layers on the bottom of the printed circuit board for the active electronics (electronic partial circuits 18*a-c*). Below a further sheet (third layer 22*c*) for the electronics, the electronic components for controlling a feeding antenna (not shown) are on the bottom of the same. Alternatively, the substrate 12 can also include merely one layer, two layers or more than three layers. Simply put, the second layer 22*b* might not be arranged or can be configured in the form of several layers.

The reflector structures 14 can also be integrated (embedded) in one of the layers 22*a*, 22*b* or 22*c* e.g. as conductive "islands" of a printed circuit board. If, for example, the second layer 22*b* is not arranged, merely one of the metallic sheets 24*a* or 24*b* can be arranged between the layers 22*a* and 22*c*.

Further, the reflector structures 14 can comprise differing polarization directions (preferential directions). Different polarization directions can be arranged in different substrate planes. The substrate planes can be arranged parallel to a substrate surface (side of the substrate 12 facing the electromagnetic wave 16 or facing away from the same).

The substrate can include, for example a liquid crystal (LC) substrate layer that is arranged such that the reflector structures are between a (virtual) source of the electromagnetic source wave and the LC substrate sheet. By means of the LC substrate sheet, a phase assignment of the main and sub reflector, respectively, can be realized in a readjusting manner on the basis of a printed circuit board, i.e. reflection characteristics can be influenced based on a control of the liquid crystal elements.

In other words, FIG. 2 shows a possible layer structure of a main reflector printed circuit board. The top sheet (i.e. above the first layer 22*a*) is formed by the reflective elements (reflector structures 14) that can impress a phase function of the incident radiation 16 and that are on a substrate (first layer 22*a*). Below this substrate is a metallic sheet 24*a* that serves, for example as ground plane and ensures the reflection of all incident beams.

Instead of two galvanically separated ground planes 24*a* and 24*b* for reflective elements and electronics, the reflector 20 can also comprise merely one common ground plane in the layer structure and hence for the reflective elements 14 and the electronics 18*a-c* without any further intermediate layer for the stability of the printed circuit board.

The (upper) substrate layers of the main reflector for the reflective elements (substrate layers 22*a*) can be implemented both as one layer or in a multilayered manner, wherein in a multilayered implementation further reflective elements can be arranged between the metallic layers. Further, adhesive layers physically connecting these layers (multilayer reflect array) can be arranged. One advantage, possibly the main advantage of the multilayered implementation is the greater realizable bandwidth of the main reflector. The same also applies for the layers of the sub-reflector if the same is implemented as printed circuit board version.

The bottom substrate layers (22*c*) of the main reflector for the electronics can be implemented as one layer and also in a multilayered manner, wherein, with several layers, again metallic layers can be arranged with conductive traces and adhesive layers connecting the different substrate layers.

Individual substrate layers of the main reflector printed circuit board or the subreflector printed circuit board can be adhered or mechanically fixed/held together or with other means.

FIGS. 3A-3D each show schematic top views of possible embodiments of the reflector structures.

Figure 3A:
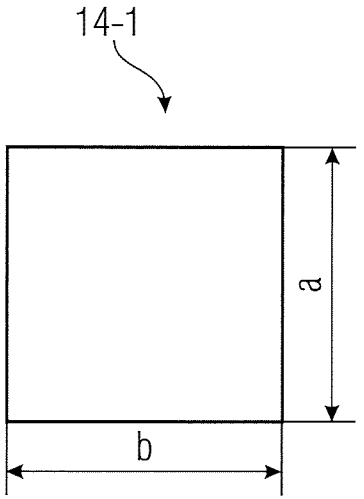
FIG. 3A is a schematic top view of a reflector structure implemented as rectangle according to an embodiment.

FIG. 3A shows a schematic top view of a reflector structure 14-1 implemented as a rectangle with a first lateral dimension a and a second lateral dimension b. The lateral dimensions a and b can have a differing or the same value (square).

Figure 3B:
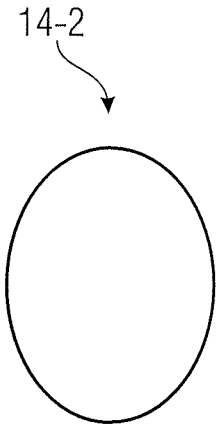
FIG. 3B is a schematic top view of a reflector structure configured as ellipse according to an embodiment.

FIG. 3B shows a schematic top view of a reflector structure 14-2 implemented as ellipse. A ratio of main and secondary axis is arbitrary.

Figure 3C:
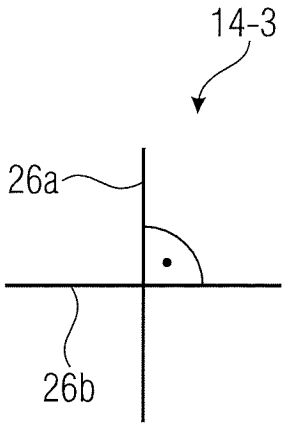
FIG. 3C is a schematic top view of a reflector structure implemented as combination of two dipole structures according to an embodiment.

FIG. 3C shows a schematic top view of a reflector structure 14-3 implemented as a combination of two dipole structures 26*a* and 26*b*. The dipole structures 26*a* and 26*b* are arranged perpendicular to one another allowing highly insulated and decoupled reflection of incident electromagnetic waves having different polarization directions. The perpendicular arrangement of the dipole structures 26*a* and 26*b* allows, for example, a reflection of polarization directions perpendicular to one another, such as horizontally and vertically, wherein these orientations can be rotated each or together in an arbitrary manner in space or can also be designated differently. Alternatively, the dipole structures 26*a* and 26*b* can also have an angle differing by 90° and/or reflect polarization directions that have the same or a differing angle.

The dipoles 26*a* and 26*b* each have an increased degree of reflection when the electromagnetic wave is received with a polarization corresponding to the arrangement of the respective dipole 26*a* or 26*b* and a degree of reflection reduced with respect thereto when the electromagnetic wave is received with a different polarization direction, in particular one that is arranged perpendicular thereto. If the electromagnetic wave is received, for example with a first polarization, the dipole structure 26*a* comprises, for example, a high (first) degree of reflection. If the electromagnetic wave is received with a second polarization differing from the first polarization, for example perpendicular thereto, the dipole structure 26*a* has a lower (second) degree of reflection. The first polarization can be referred to as preferential direction with respect to the dipole 26*a*. The dipole 26*b* comprises, for example with the second polarization, a high (third) degree of reflection and when the electromagnetic wave comprises the first polarization, a lower (fourth) degree of reflection by which the electromagnetic wave is reflected.

The first and the third degree of reflection are greater than the second and the fourth degree of reflection. The first and the third or the second and the fourth degree of reflection can also be the same. Simply put, the dipole 26*a* can be configured to reflect the first polarization and the dipole 26*b* can be configured to reflect the second polarization. Further, the dipole structures 26*a* and 26*b* can be configured to impress differing phase functions on a reflected electromagnetic wave.

Several different polarizations can be obtained by connecting a plurality of antenna structures or elements with the electronic circuit, wherein a first subset of the antenna structures or elements is configured to generate an electromagnetic wave with a first polarization and a second subset of the antenna structures or elements is configured to generate an electromagnetic wave with a second polarization. Additionally, further antenna structures or elements can be arranged that are configured to generate an electromagnetic wave with at least one further polarization.

Figure 3D:
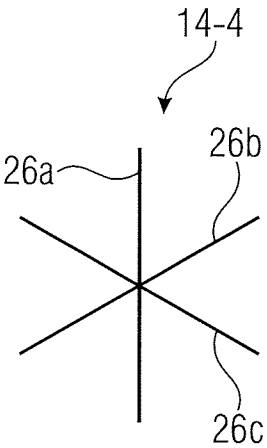
FIG. 3D is a schematic top view of a reflector structure including three dipole structures arranged at an angle to one another according to an embodiment.

FIG. 3D shows a schematic top view of a reflector structure 14-4 including three dipole structures 26*a*, 26*b* and 26*c* each arranged at an angle to one another, which allows reflection of three respective polarizations. The dipole structures 26*a-c* can have any angle to one another and can be matched, for example, to polarizations of electromagnetic waves to be transmitted. Alternatively, more than three dipole structures or merely one dipole structure can be arranged.

Alternatively, the reflector structures can also have any other form, such as a polygon form, a circular form, a free form or a combination of forms and/or dipole structures.

In other words, the reflective elements can have any geometry when implementing the main and sub-reflector, respectively, as reflect array. Further, any method can be used for implementing the desired phase change on the aperture of the reflector, such as a variable size of the elements, mounted line parts and/or rotation of the elements with respect to one another.

Figure 4:
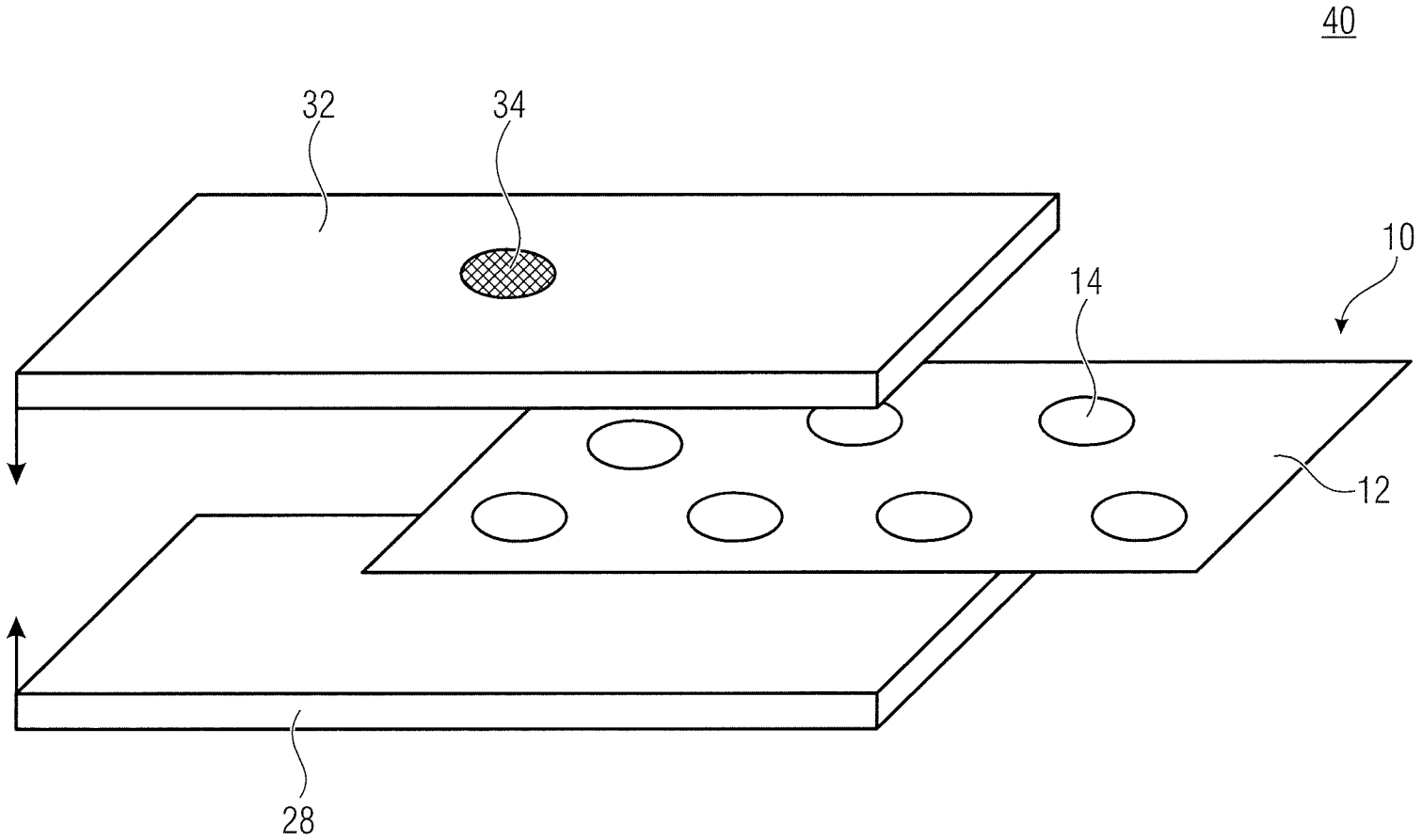
FIG. 4 is a schematic view of a reflector extended, with respect to the reflector of FIG. 1, by a housing part according to an embodiment.

FIG. 4 shows a schematic view of a reflector 40 extended with respect to the reflector 10 such that a housing part 28 is arranged on a side of the substrate 12 facing away from the reflector structures 14. The housing part 28 can, for example, be used as cover of the electronic circuit that is arranged on the substrate 12 facing the housing part 28. The housing part 28 can include non-conductive (for example including plastic materials or resin materials) or conductive materials (for example metals). Simply put, the housing part 28 can be a metallic cover.

A radome structure 32 is arranged on the side of the substrate 12 facing the reflector structures 14. Merely for illustration purposes, the substrate 12 is arranged in an offset manner with respect to the housing part 28 and the radome structure 32, i.e., the substrate 12, the housing part 28 and the radome structure 32 can also be arranged such that the substrate is enclosed (housed) by the housing part 28 and the radome structure 32. The housing can be water tight and/or chemically resistant.

The radome structure 32 includes, at least in certain areas, an electrically conductive structure 34. The electrically conductive structure 34 is configured to reflect the electromagnetic wave and is arranged, with respect to the plurality of reflector structures 14, such that the electromagnetic wave reflected by the electrically conductive structure 34 is directed in the direction of the plurality of reflector structures 14 and is reflected again by the same. If, for example, an antenna is arranged between the housing part 28 and the radome structure 32 (such as on or in the substrate 12), this antenna can be configured to emit the electromagnetic wave in the direction of the electrically conductive structure 34, such that the electrically conductive structure 34 reflects the electromagnetic wave in the direction of the reflector structures 14. The electrically conductive structure 34 can provide the function of a sub-reflector. The sub-reflector can be arranged as part of a double reflector system where the reflector 10 and 20, respectively, are arranged as main reflector. The reflector structures 14 can then provide the electromagnetic wave with the phase function and emit the same (through the radome structure 32). Alternatively or additionally, the radome structure 34 can also include a further plurality of reflector structures.

In other words, a radome layer can be arranged above the reflective elements/the electronics of the main reflector printed circuit board in order to cover the elements and protect them from corrosion and external influences or to at least reduce the influence. This radome layer can additionally change the reflection characteristics of the reflective elements and can serve as thermal heat dissipation for the electronics, respectively.

Figure 5:
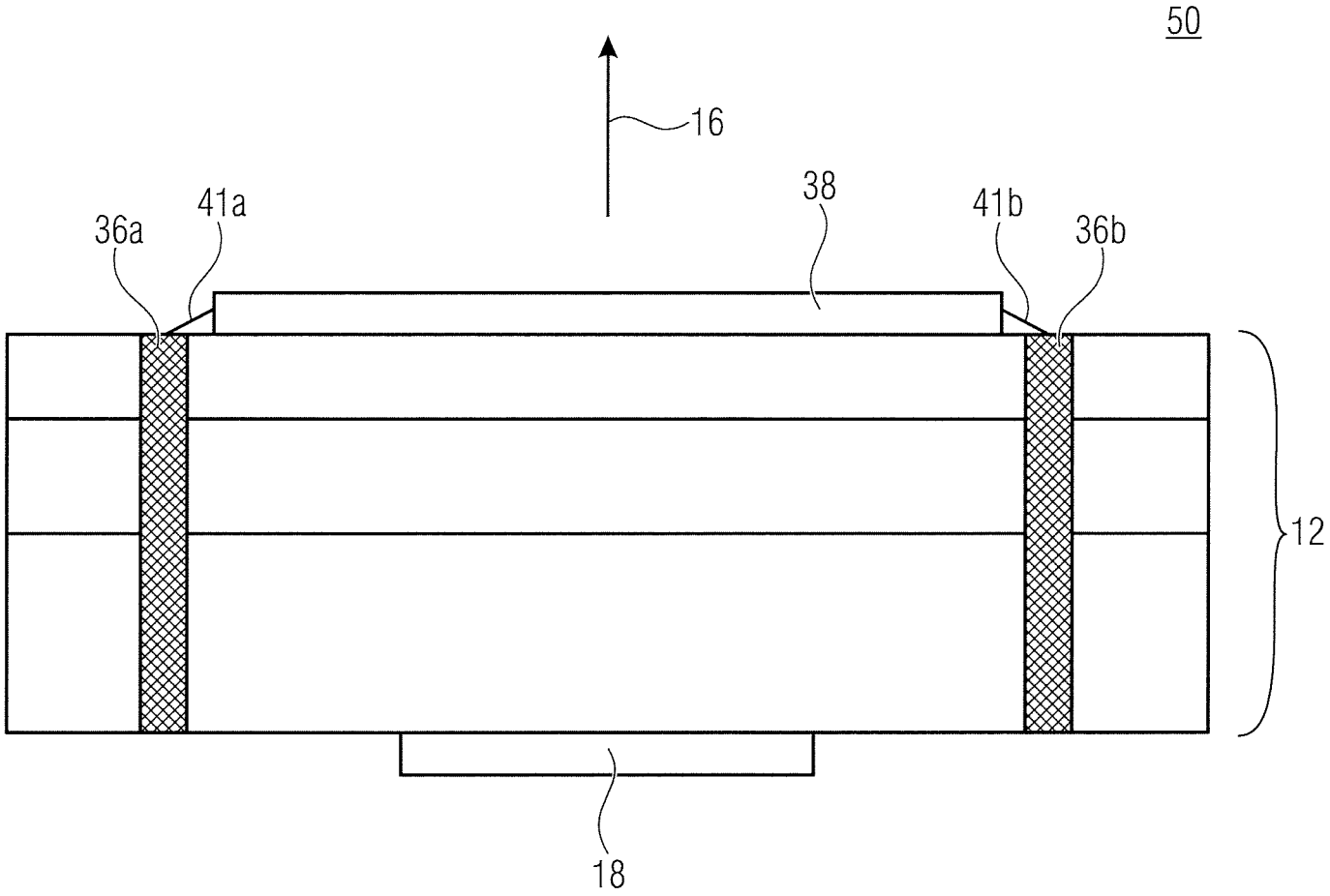
FIG. 5 is a schematic side sectional view of a reflector where the substrate includes vertical interconnect access (vias), according to an embodiment.

FIG. 5 shows a schematic side sectional view of a reflector 50 where the substrate 12 includes, compared to the reflector 20, vias 36*a* and 36*b*, such that electric signals can be directed from the electronic circuit 18 through the substrate 12 to the side of the substrate 12 opposing the electronic circuit 18. An antenna 38 is arranged on the substrate 12, which is configured to emit a radio signal, for example in the form of the electromagnetic wave 16. The antenna 38 is connected to the vias 36*a* and 36*b*, respectively, and hence to the electronic circuit 18, for example by means of bond wires 41*a* and 41*b*. The electronic circuit 18 is configured to control the antenna 38 such that parameters of the electromagnetic wave 16, such as signal shape, transmission period, signal amplitude and/or transmission frequency, are influenced by the control of the electronic circuit 18. The reflector structures (not shown) are arranged on the same side of the substrate 12 as the antenna 38.

Alternatively or additionally, reflector structures can be arranged in the substrate 12. Alternatively, the electronic circuit 18 can also be arranged on the same side as the antenna 38 on the substrate 12 and/or can be implemented in the form of partial circuits. An arrangement of the antenna 38 on the substrate 12 allows a highly integrated wiring of electronic circuit 18 and antenna 38 which can result in low power losses and hence an efficient operation. Hence the reflector 50 can also be described as antenna device including the electronic circuit 18, the substrate 12 and the antenna 38.

The antenna 38 can be any antenna. It can, for example, be an on-chip feeding antenna, a patch antenna, a PIFA antenna, a waveguide antenna, a silicon-based antenna or any other antenna.

If, for example, the radome structure described in the context of FIG. 4 including the electrically conductive structure is combined with the antenna device 50, an antenna form including a double reflector system can be obtained. This antenna form can, for example, be implemented as Cassegrain antenna or as Gregorian antenna such that an integrated Cassegrain antenna or an integrated Gregorian antenna can be obtained.

In other words, FIG. 5 shows an example for the connection of the electronic components of the bottom layers with the on-chip feeding antenna on the top of the main reflector printed circuit board. In this example, the connection of the electronics to an SMD on-chip antenna is realized by means of vias and optional bond wires. The sub-reflector 42 can, for example, be part of a radome structure.

Figure 6:
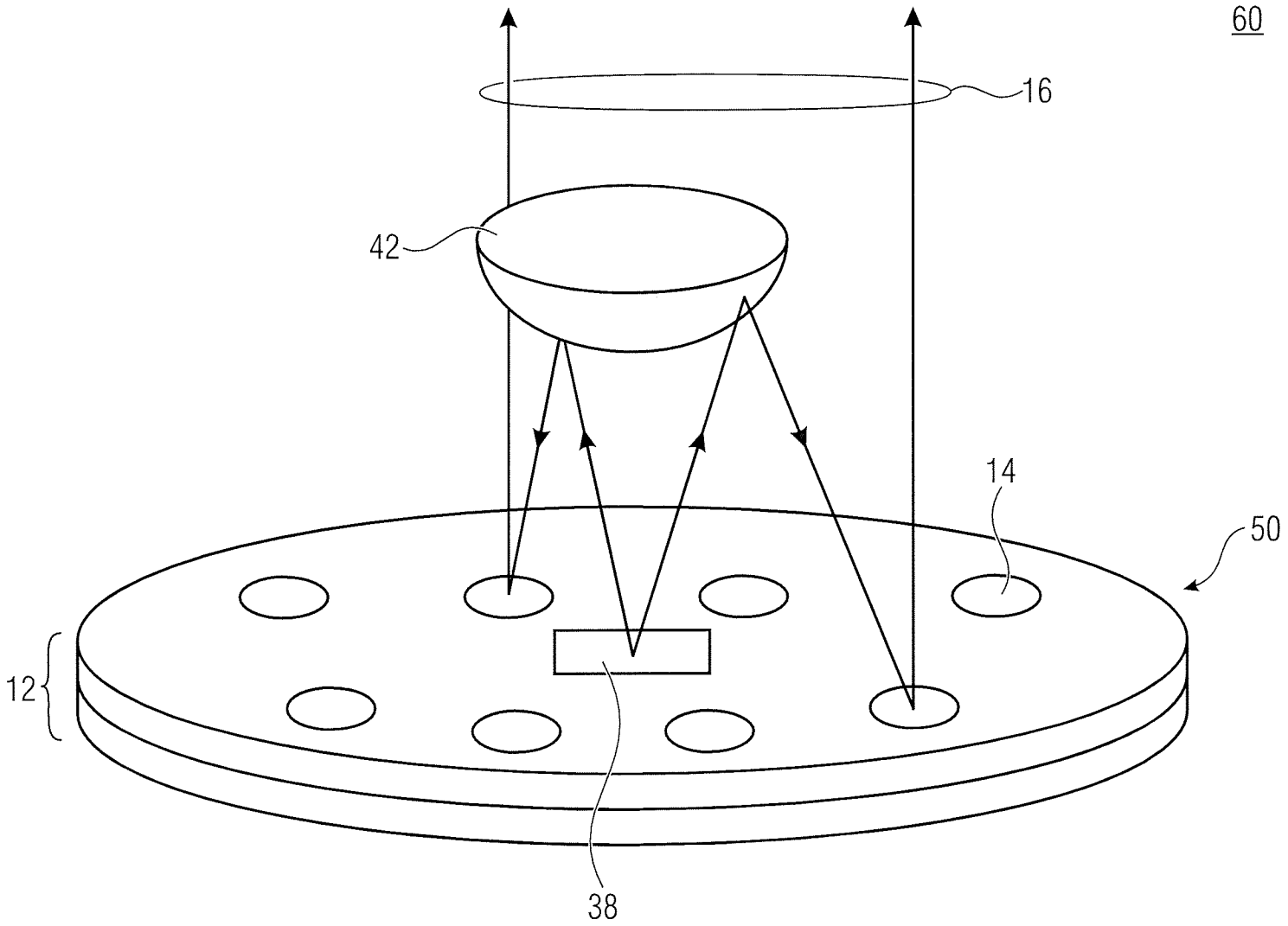
FIG. 6 is a schematic block diagram of an antenna device, a reflector and an antenna according to an embodiment.

FIG. 6 shows a schematic block diagram of an antenna device 60 including the substrate 12 on which the plurality of reflector structures 14 are arranged. The antenna 38 is mounted on the substrate 12 on the same side as the plurality of reflector structures 14 and is configured to generate and emit the electromagnetic wave 16. The electromagnetic wave 16 can be radiated (spatially) wide, i.e., with a great aperture angle. This means that the electromagnetic wave 16 can have a low directivity. Regarding the substrate 12, a further reflector structure is arranged, referred to as sub-reflector 42 below. The sub-reflector 42 can, for example, be a conductive layer formed in an concave or convex manner. Alternatively, the sub-reflector 42 can also be configured in a planar manner, for example, including a substrate and/or a printed circuit board with reflector structures that are configured to impress a phase function on the received and reflected electromagnetic wave 16. Simply put, the sub-reflector 42 is arranged and configured to scatter the electromagnetic radiation received from the antenna 38 and to reflect the same at least partly in the direction of the reflector structures 14. The reflector structures 14 are configured to reflect the electromagnetic wave 16 reflected by the sub-reflector 42 again and to adapt the phase function of the electromagnetic wave 16 such that the electromagnetic wave 16 experiences beam focusing with respect to the characteristic of the antenna 38. In that way, the electromagnetic wave 16 can be emitted, for example, approximately or completely in a collimated manner, such that an application of the antenna device 60 as directional radio antenna is possible.

Figure 7A:
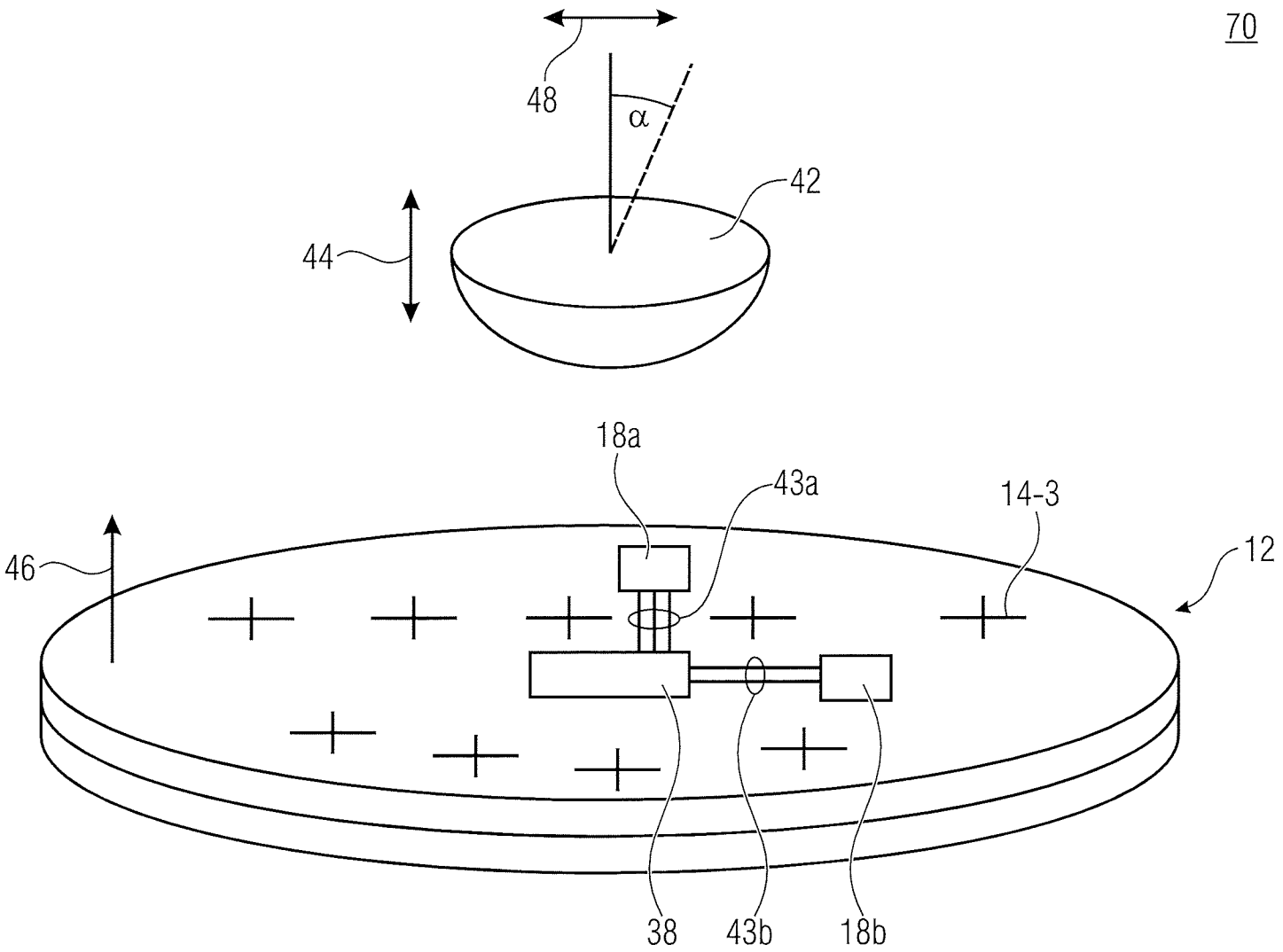
FIG. 7A is a schematic block diagram of an antenna device where a plurality of reflector structures according to FIG. 3C are arranged on the substrate according to an embodiment.
Figure 7B:
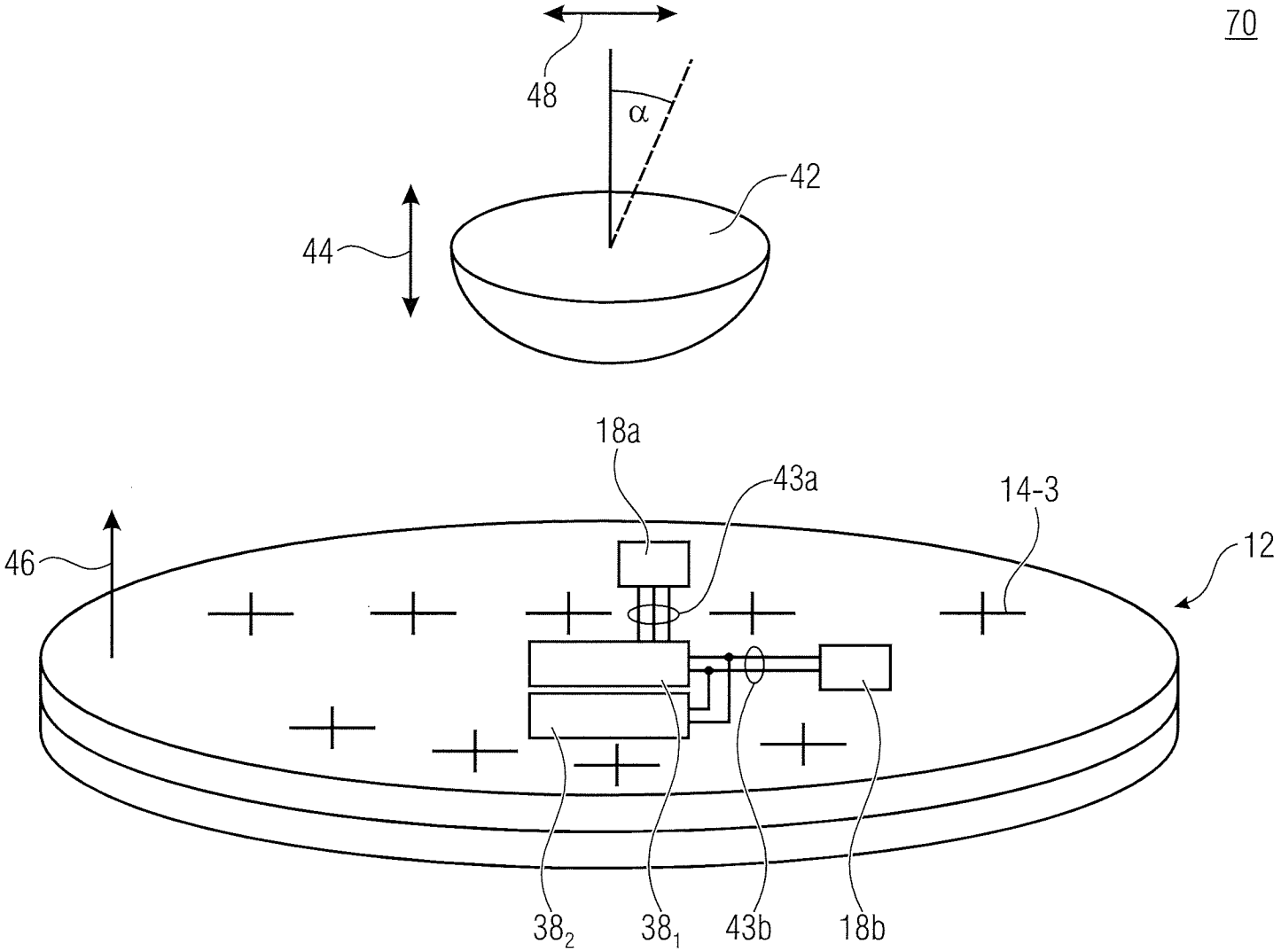
FIG. 7B is a schematic block diagram of an antenna device to illustrate a plurality of antenna elements 381 and 382 according to an embodiment.

FIG. 7 shows a schematic block diagram of an antenna device 70 where a plurality of reflector structures 14-3 are arranged on the substrate 12. The electronic circuit includes the partial circuits 18*a* and 18*b* that are arranged on the same side of the substrate 12 as the reflector structures 14-3 and the antenna 38. The electronic partial circuits 18*a* and 18*b* are, for example, connected to the antenna 38 by means of so-called microstrip lines (MSL) 43*a* and 43*b*, respectively. The sub-reflector 42 is tiltable by an angle $\alpha$ with respect to the substrate 12 and with respect to the antenna 38 and/or the reflector structures 14-3, respectively. The sub-reflector is formed in a convex manner or is configured to impress a convex phase function on the electromagnetic wave. The angle $\alpha$ can, for example, be less than 90°, less than 60° or less than 30°. With the sub-reflector 42, the electromagnetic wave can also be tilted in space with regard to the impressed phase function, such that all in all a radiation characteristic by which the electromagnetic wave is reflected from the reflector structures 14-3 is changed.

The electromagnetic wave can be reflected, for example, in a spatial direction variable by the angle $\alpha$. Further, the sub-reflector 42 is movable along an axial direction 44. Thus, a distance between the sub-reflector 42 and the substrate 12 and the antenna 38, respectively, is variable along the axial direction 44. The axial direction 44 runs, for example, parallel to a surface normal 46 of the substrate 12. Depending on the scattering characteristics of the sub-reflector 42, a reduced distance between the antenna 38 and the sub-reflector 42 can result in a narrowing or extension of a lobe of the electromagnetic wave. This means a focus of the electromagnetic wave radiated from the reflector structures 14-3 is variable with the distance and the movement along the axial direction 44, respectively. This enables adjustment or correction of the directivity of the antenna structure 70, for example, due to variable environmental influences, such as heating and/or variable materials between the antenna device 70 and the further antenna device with which the antenna device 70 communicates.

Alternatively or additionally, the sub-reflector 42 can also be moveable along a lateral direction 84 arranged perpendicular to the surface normal 46. Alternatively, the sub-reflector 42 can also be arranged rigidly or merely tiltable by the angle $\alpha$ or moveable along the direction 44.

A position of the dipoles of the reflector structures 14-3 can be adapted to a polarization or several polarizations by which the electromagnetic wave is emitted from the antenna device 70. Alternatively or additionally, other reflector structures can be arranged. The antenna 38 is configured to direct an electromagnetic wave transmitted in the direction of the antenna device and received by the antenna device 70 to the electric circuit (not shown) or a further electric circuit that is arranged, for example, on a side of the substrate 12 facing away from the antenna 38.

Alternatively, the substrate 12 and the (main) reflector, respectively, can also comprise several antennas 38 that can be configured in the same or in a differing manner. Concerning the plurality of antennas, a plurality of sub-reflectors 42 can be arranged. For example, each sub-reflector can be allocated to one of the arranged antennas. This enables the structure of a multi-antenna device.

Figure 8:
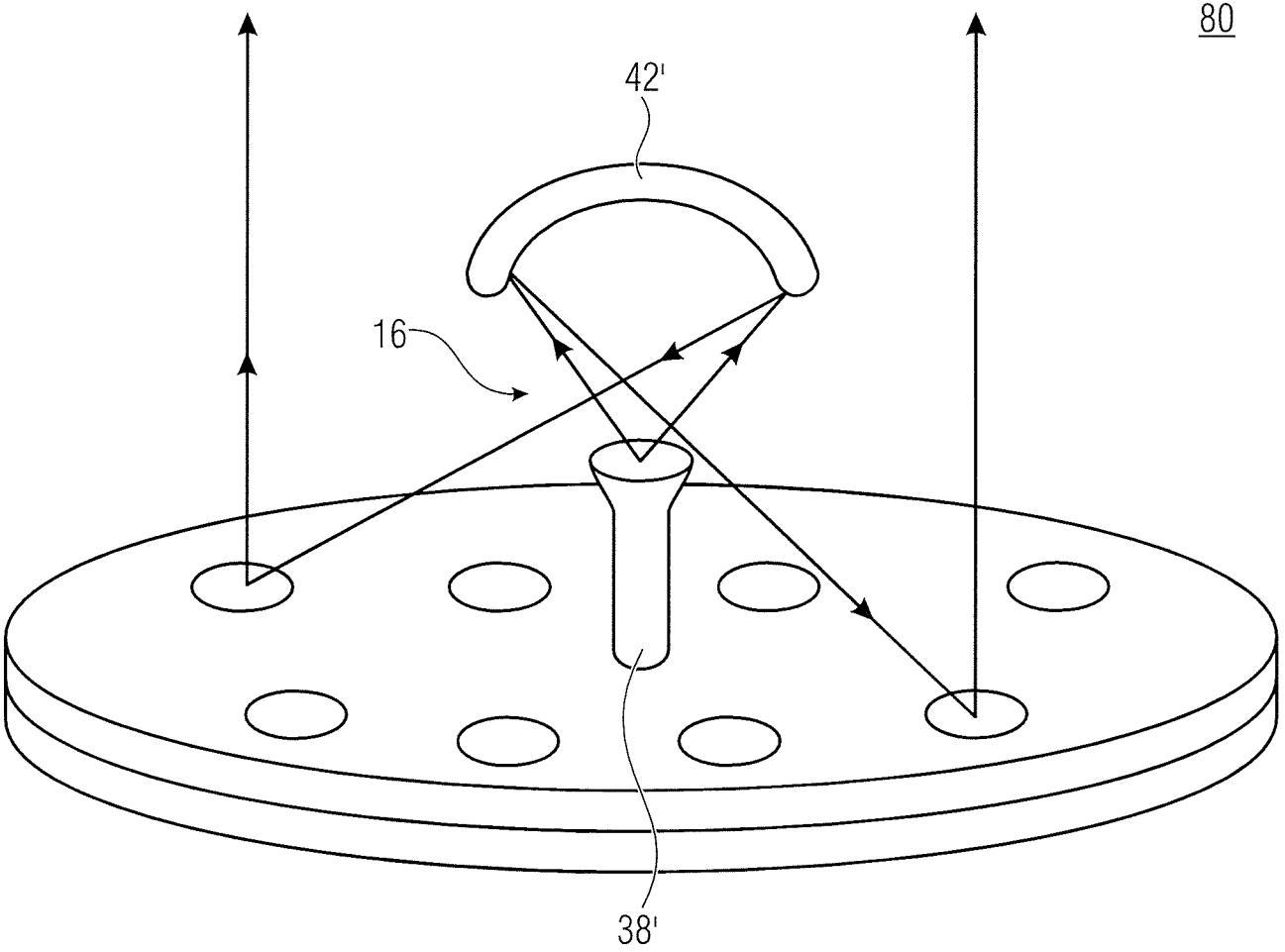
FIG. 8 is a schematic block diagram of an antenna device including a horn antenna according to an embodiment.

FIG. 8 shows a schematic block diagram of an antenna device 80 including an antenna 38'. The antenna 38' is implemented as a horn antenna. Regarding the antenna 38', a sub-reflector 42 is arranged that is configured to model a concave shape by means of the phase function. The sub-reflector 42' can be implemented, for example, as a concave metallic element. Alternatively, the sub-reflector 42' can also be implemented as (planar) printed circuit board that is configured to impress a respective phase function by means of a suitable arrangement of reflector structures.

The antenna device 80 can, for example, be used as a Gregorian antenna. Here, the configuration of the sub-reflector 42 or 42' can be selected independently of an implementation of the antenna 38 and 38'. In that way, the antenna device 80 can, for example, also include the antenna 38 and/or the sub-reflector 42.

Figure 9:
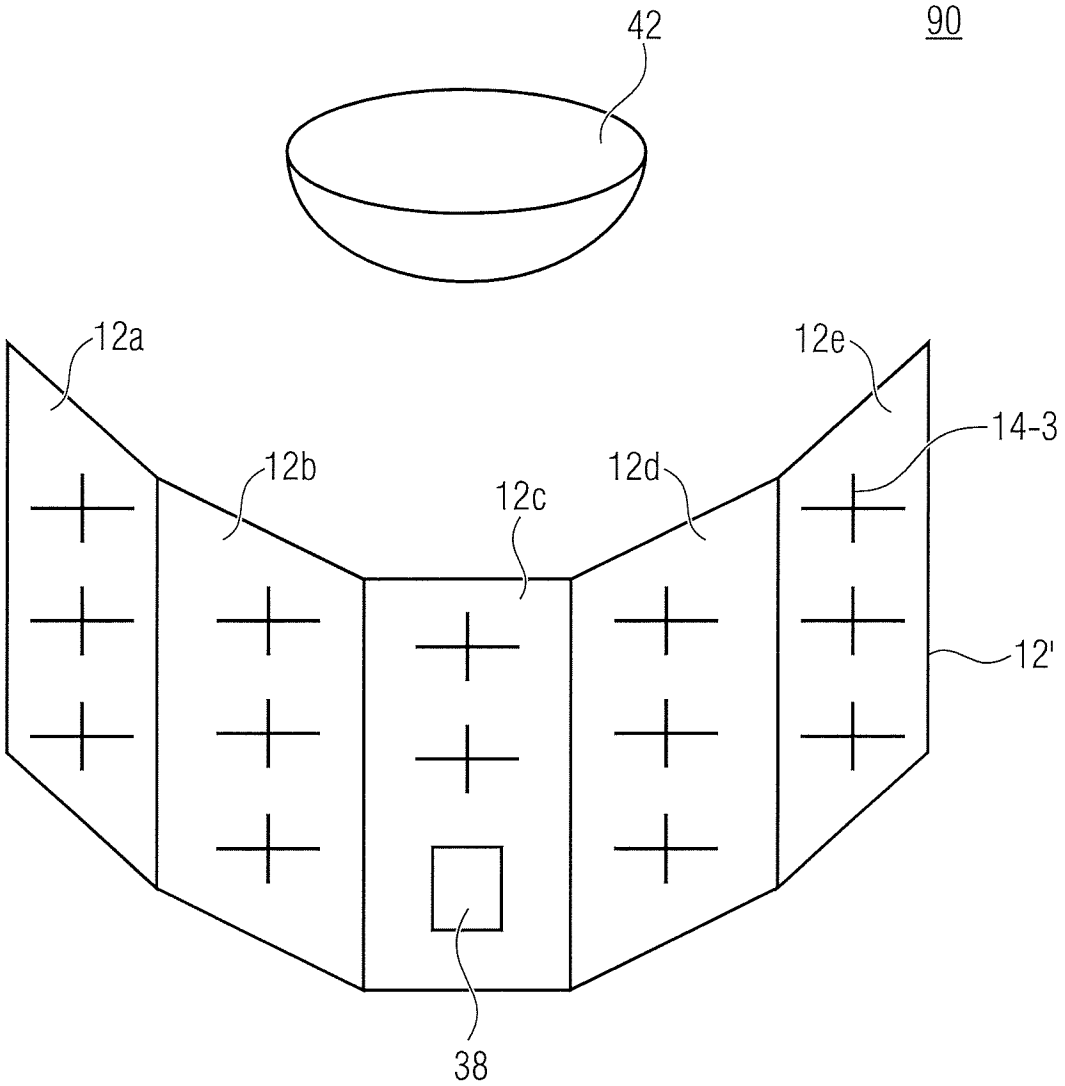
FIG. 9 is a schematic block diagram of an antenna device where a substrate comprises a non-planar form according to an embodiment.

FIG. 9 shows a schematic block diagram of an antenna device 90, wherein a substrate 12' (main reflector) comprises a non-planar shape. The same is obtained, for example, by a respectively inclined arrangement of several (possibly planar) partial substrates 12*a-e* with respect to one another. This can also be referred to as sector paraboloid and multi-faceted reflect array (reflector having several surfaces), respectively. By means of the partial substrates 12*a-b* that are inclined to one another, a concave or convex form or a form that is continuous in parts (for example, parabolic form) of the substrate 12' and hence the main reflector can be obtained. Simply put, the main reflector and/or the substrate 12' can be implemented in several parts, wherein the parts can be arranged parallel to one another or at an angle to one another. The antenna 38 is, for example, arranged offset from a central position (so-called offset feeding). Alternatively, the antenna 38 can also be arranged in a geometric or area centroid. The antenna device 90 can also be described as 1D multifaceted reflect array configuration.

In other words, the main reflector can be implemented as sector paraboloid (multifaceted reflect array), based on the printed circuit board, with the electronics for controlling the feeding antenna(s) and/or in a physically curved form (conformal antenna) with one or several printed circuit boards in order to realize the desired phase function. The electronics for controlling the feeding antenna(s) is arranged on at least one of these printed circuit boards (i.e., sectors, facets and panels 12*a-e*, respectively). A sub-reflector based on the printed circuit board can be implemented, for example, as several printed circuit boards in sector form. It is an advantage of a sector form that compared to a planar configuration a higher bandwidth of the antenna can be realized and the higher phase reserve of the reflector structure can be obtained.

Figure 10:
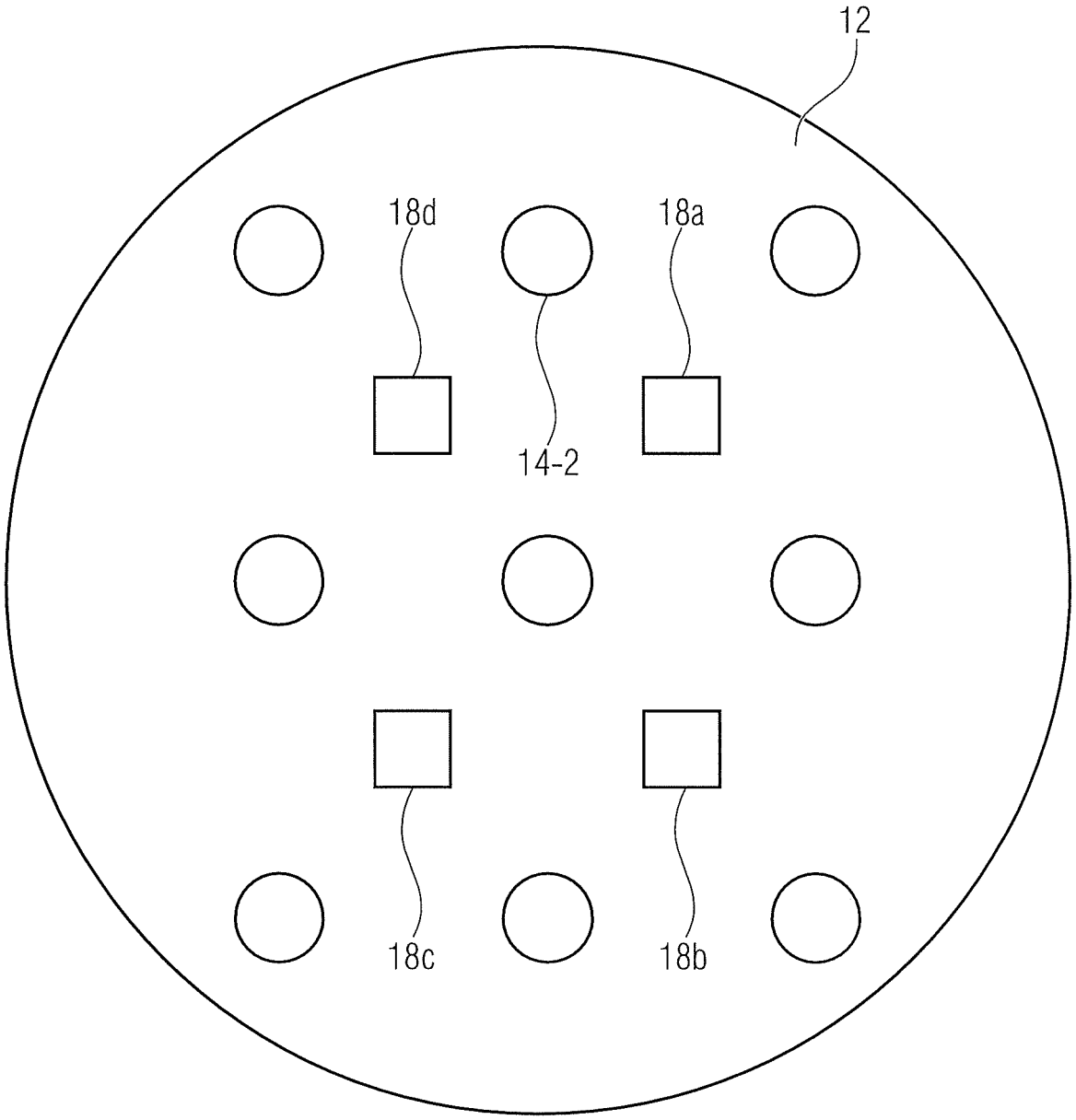
FIG. 10 is a schematic top view of a substrate on which a plurality of reflector structures and electric partial circuits are arranged according to an embodiment.

FIG. 10 shows a schematic top view of the substrate 12 where a plurality of reflector structures 14-1 and partial circuits 18-*d* are arranged. Alternatively or additionally, further and/or differing reflector structures can be arranged.

Figure 11:
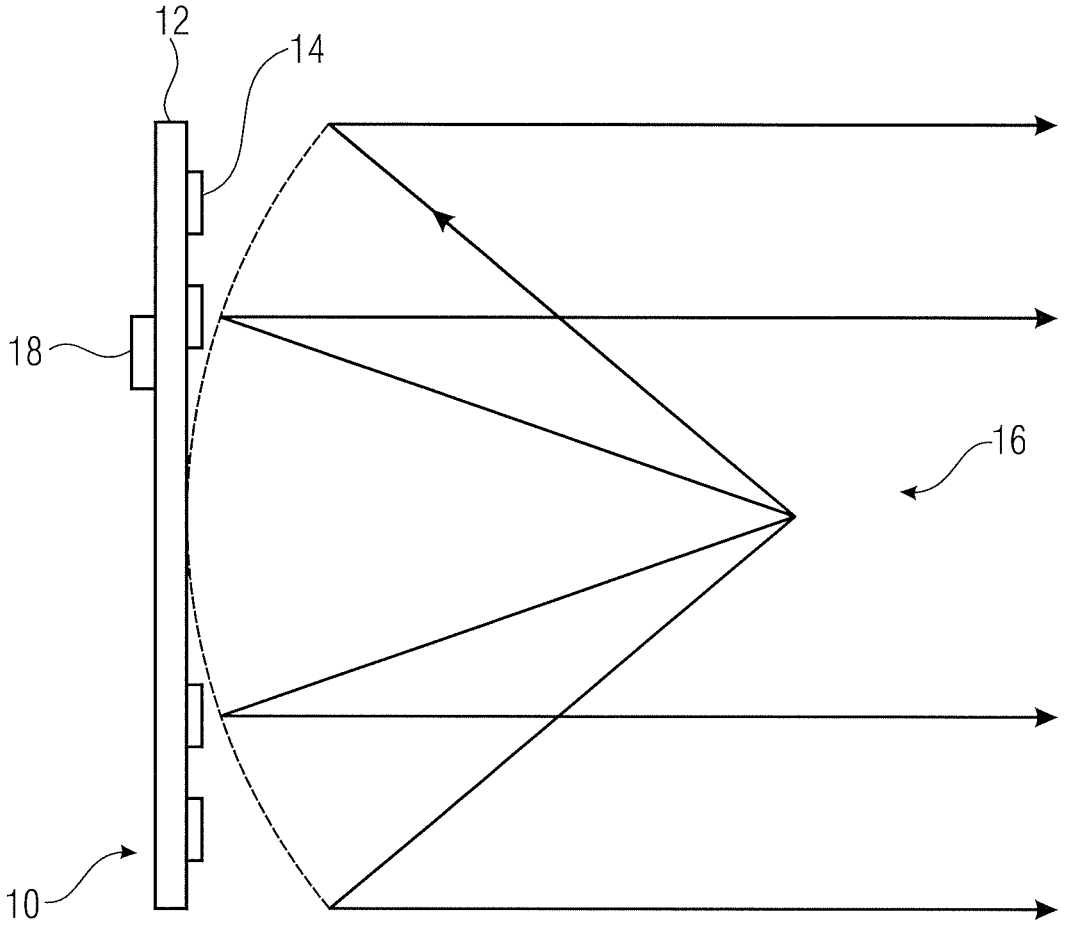
FIG. 11 is a schematic side view of the reflector of FIG. 1 for illustrating the function of the impressed phase function according to an embodiment.

FIG. 11 shows a schematic side view of the reflector 10 for illustrating the function of the impressed phase function, wherein the explanations can also be applied to a subreflector. The phase function impressed by the reflector structures 14 of the electromagnetic wave 16 allows implementation of a virtual model of the reflector 10. The dotted concave line illustrates the implemented virtual parabolic form of the reflector. Thus, the reflector 10 can comprise, for example, a planar substrate 12 with the reflector structures 14 arranged thereon. By means of the phase function, the electromagnetic wave 16 can be reflected as if the same would be reflected by a concave (or alternatively convex) or parabolic reflector.

Figure 12:
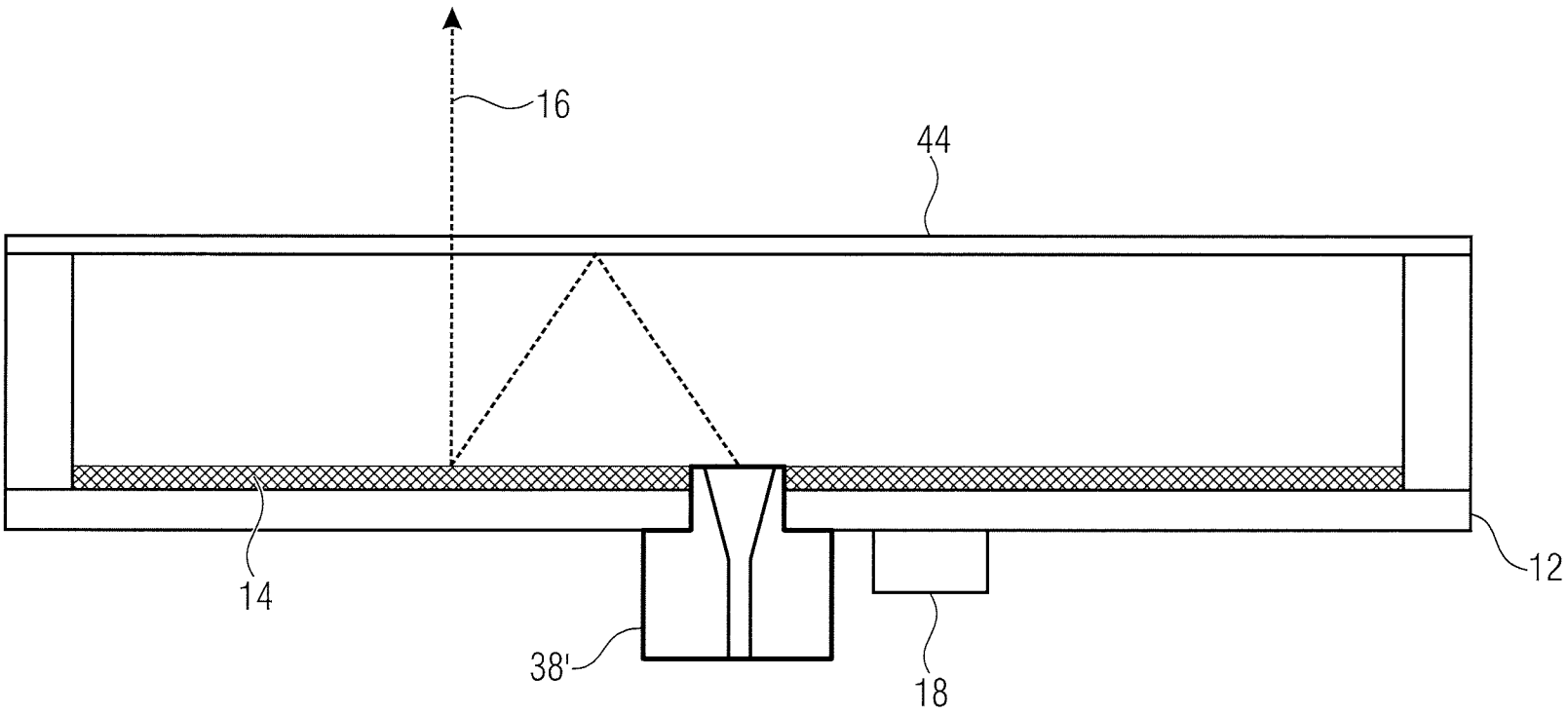
FIG. 12 is a schematic side view of an antenna device configured as folded reflect array antenna according to an embodiment.

FIG. 12 shows a schematic side view of an antenna device 120 that is implemented as a folded reflect array antenna. The antenna device 120 includes, for example, the horn antenna 38' or alternatively any other antenna form. Regarding the antenna 38', a sub-reflector is arranged in the form of a polarizing grid or a slit array 44. The polarizing grid or the slit array 44 is configured to polarize and reflect the electromagnetic wave 16 when the same comprises a first polarization. The reflector structures 14 are configured to rotate a polarization of the electromagnetic wave and to focus the electromagnetic wave 16. In that way, for example, the slit array 44 can be configured to let the electromagnetic wave 16 to pass in a large part or completely when the same comprises the rotated (second) polarization.

As a physically curved variation, the sub-reflector can be implemented in a convex manner (for example for a Cassegrain antenna), a concave manner (for example for a Gregorian antenna) manner or also as a printed circuit board (reflect array). A folded antenna (folded reflect array) can also be arranged as a reflector system.

In such a case, a focusing and contoured beam function, respectively, of the main reflector based on the printed circuit board as a reflect array is still given. For example, a polarization-selective grid having a similar or the same size as the main reflector can be deposited above the same as a sub-reflector. The feeding antenna can still be at a position below the sub-reflector grid. The incident beams of the feeding antenna are reflected by this grid in a polarization-dependent manner, wherein the polarization can be partly rotated during reflection. During reflection at the main reflector reflect array, the polarization of the incident radiation is again partly rotated and at the same time focused or formed in the desired manner, respectively. The beams can now pass the sub-reflector without reflection. Thereby, this folded form of the antenna can also be built in a very compact manner, however, due to the polarization selectivity of the sub-reflector, the same can only be realized with one polarization and specific reflective elements on the main reflector that rotate the polarization of the incident beams at the implemented reflection.

Figure 13:
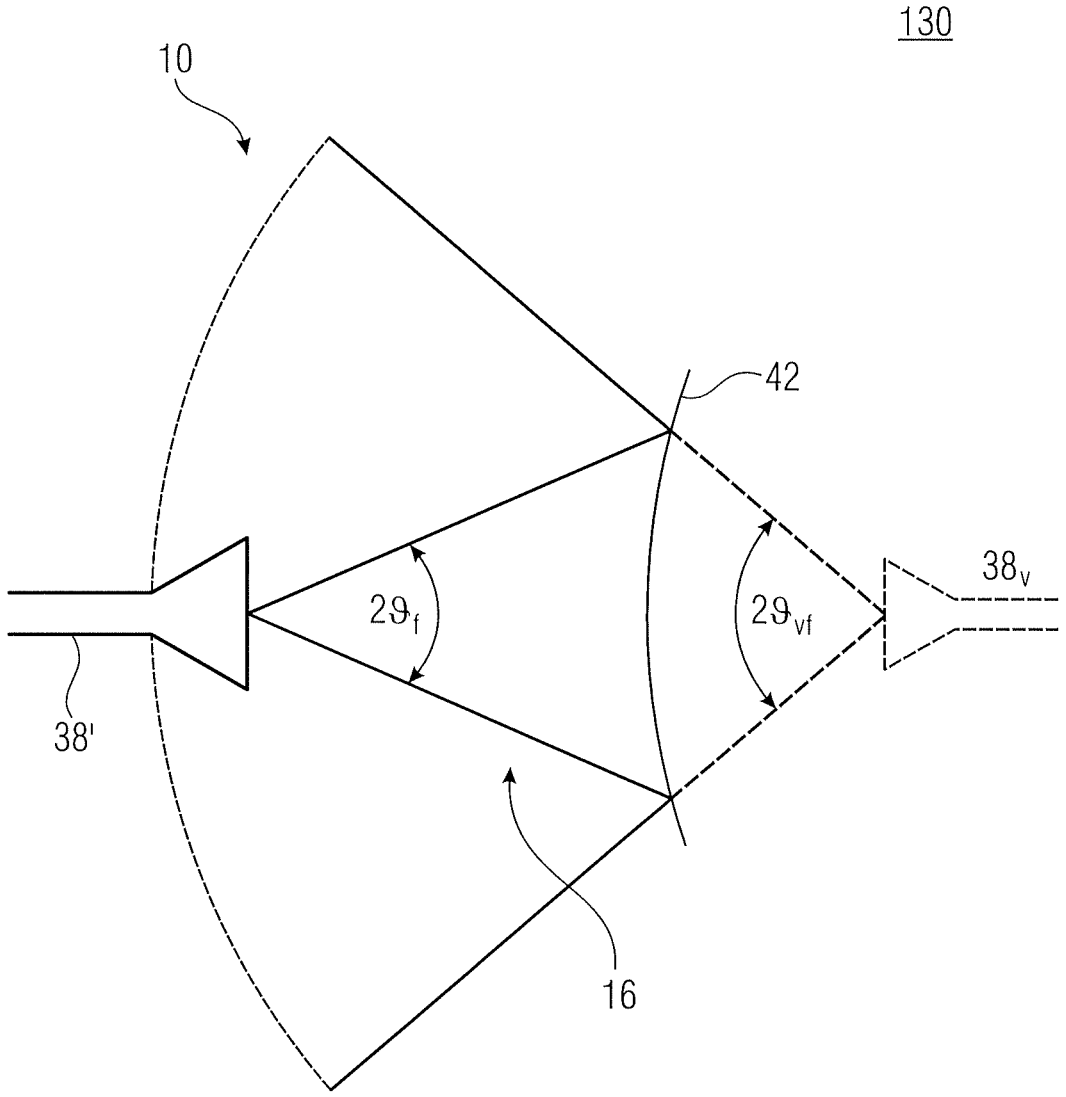
FIG. 13 is a schematic view of an antenna device including the horn antenna and the reflector according to FIG. 1 according to an embodiment.
Figure 14:
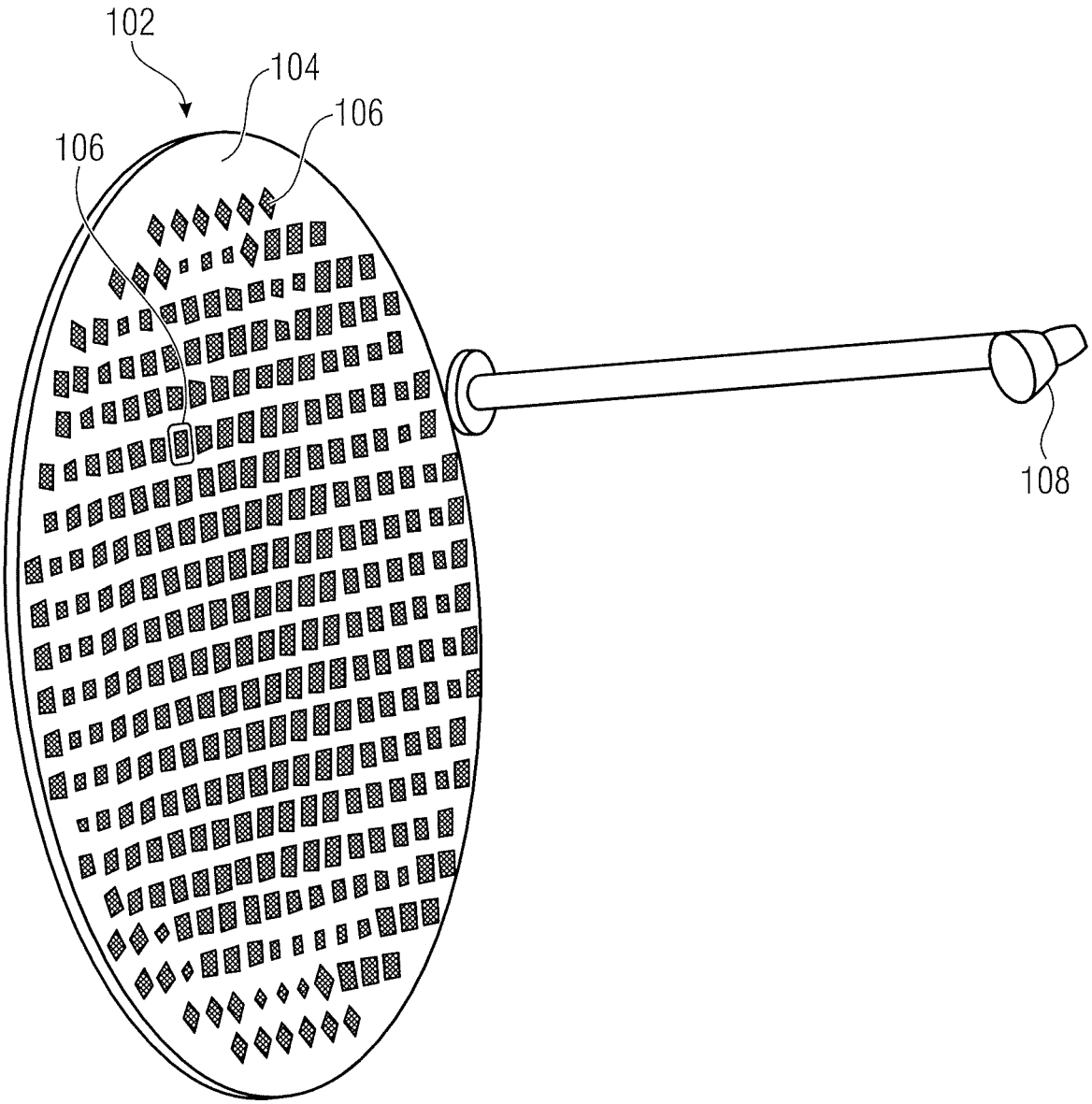
FIG. 14 is a schematic illustration of a reflect array according to conventional technology.

FIG. 13 shows a schematic view of an antenna device 130 including the horn antenna 38' and the reflector 10. By means of the reflector 10, a reflector characteristic is obtained analogous to a parabolic main reflector. Regarding the reflector 10, the sub-reflector 42 is arranged that reflects the electromagnetic wave 16 emitted with an aperture angle of 2 $\vartheta_f$ and reflects the same in the direction of the reflector 10. Regarding the reflector 10, this acts like a virtual antenna (virtual feed) $\mathbf{38}_v$, that emits the electromagnetic wave with the aperture angle 2 $\vartheta_{vf}$. Simply put, this implements a function of a Cassegrain antenna.

Simply put, some of the above described embodiments can be implemented as double reflector system, for example, as Cassegrain antenna, Gregorian antenna or folded antenna. A feeding antenna can be arranged centrally on a main reflector and can be configured to irradiate (illuminate) the sub-reflector, which is again configured to illuminate the main reflector. The sub-reflector can virtually mirror the function of the feeding antenna via the main reflector. The virtual reflective point can be shifted by the convex or concave (Gregorian antenna) form of the sub-reflector in contrary to reflection at a planar metallic area. Thus, the entire antenna device can be built in a very compact manner. The main reflector can be implemented parabolically or can be configured to implement a respective phase function, i.e., the same results in a collimation of the incident radiation and hence in a directivity. Thus, the antenna can combine high directivity with a very compact structure.

The embodiments relate to a main reflector that is configured as a printed circuit board (PCB) on the top or bottom side (or another side) of which, additionally, the electronics for feeding the feeding antenna reside. On one side (for example top side), the elements of the reflect array as well as a feeding antenna are arranged. This feeding antenna can be controlled by electronics that reside on the same or on a different side or on both sides of the printed circuit board.

In embodiments, the electronic circuit (active electronics) can be on the same side of the substrate (main reflector) as the reflector structures and can be configured to control the feeding antenna from there. This can be performed, for example, by means of conductive traces, microstrip configurations, bond wire connections or the same.

The feeding antenna can be any antenna and can have a narrow or wide radiation characteristic. The feeding antenna can be configured, for example, as on-chip antenna, horn antenna, open waveguide or phased array antenna. The feeding antenna can also include several distributed antenna elements that can be excited individually or in groups for radiation. Further examples for feeding antennas are, for example, substrate-integrated waveguides, possibly with horn, (planar) mode converters with fitted horn, packaged antennas, printed planar antennas, such as a patch antenna, PI FA antennas or the same.

The feeding antenna can include one or several individual feeding antennas with the same or different polarizations. Thus, in combination with specific reflective elements on main and sub-reflector planes, respectively, multiplex, demultiplex or duplex transmission of electromagnetic waves (radio signals) can be realized in dependence on the polarization. Crossed dipoles, for example, can be arranged as reflective elements. The individual dipole arms can selectively reflect the phase of the incident beams with polarization in a longitudinal direction. As crossed dipoles, the scattering elements (reflector structures) can hence selectively reflect different, for example, orthogonal linear polarization with high insulation and hence impress different phase assignments to the different, for example, orthogonally polarized beams. This allows, for example, spatial separation, i.e., two focus points of the two linear orthogonally polarized feeding antennas. This means that two feeding antennas are arranged.

In embodiments, the feeding antenna can be arranged at a (for example vertical) position, i.e., perpendicular to the aperture of the main reflector which is on the level of the main reflector (for example in the form of a patch antenna), higher (for example in the form of a horn antenna) but also lower (for example, integrated in one of the layers of the substrate).

Embodiments include two or more feeding antennas that are configured to radiate an electromagnetic wave each having differing frequencies (so-called multiband reflect array). Alternatively or additionally, the feeding antennas can be controlled by time-division multiplexing.

A horizontal (lateral) position of the feeding antenna (in the aperture plane of the main reflector) can be at the center or at a different position (so-called offset feeding). Further, the axial or lateral position of the sub-reflector can be variable. Alternatively or additionally, the sub-reflector can also be tilted by any angle $\alpha$ (e.g., less than 90°).

An (possibly essential) function of the double reflector system is, for example, beam focusing, i.e., a high directivity of the antenna. Thus, the antenna can be used in directional radio and/or point-to-point connections (direct connections). The option of a contoured radiation (contoured beam) by means of suitable phase assignment of the main reflect array is also possible. Here, a main application is, for example, satellite radio. Also, the phase assignment (phase function) can be implemented such that multibeam, tilted beam or any other realizable form of radiation of the overall antenna is obtained.

In embodiments, the main and sub-reflector, respectively, can be moved mechanically relative to one another in order to perform, for example, beam control and sweep.

Above described embodiments describe realizations of a main reflector combining the electronics and the beam reflection with specific phase assignment of the radiation of a sub-reflector, for example in a Cassegrain antenna system or in a folding antenna on a printed circuit board. Here, one advantage is the compactness of the antenna system and the integrability of the electronics together with the reflector characteristics of the antenna on a printed circuit board.

Embodiments can be used, for example, in directional radio links (point-to-point), satellite radio and/or in radar applications. Further, antenna devices according to embodiments described above can be used anywhere where a highly integrated antenna with high directivity or continuous radiation may be used. A Cassegrain reflect array antenna with main and sub-mirror (reflector) as printed circuit board implementation can be considered as a typical application example. The sub-reflector as a printed circuit board can be embedded in a radiation-transparent radome housing, while the main reflector printed circuit board is fitted on a metallic housing whose function includes protecting the electronics as well as shielding the same (in the sense of EMC) and/or heat dissipation of the electronic components. The two housing components can be joined mechanically (possibly in a watertight and/or chemical-resistant manner) and enclose the main reflector printed circuit board with a deposited on-chip feeding antenna. External terminals, i.e., for contacting the antenna device, can be configured, for example, in the form of a data terminal and as energy supply terminal.

While the antenna and/or the antenna device have been described above such that the same are configured to generate and emit the electromagnetic wave 16, embodiments can also be used to alternatively or additionally receive the electromagnetic wave 16, such that the same can be evaluated with the electronic circuit or a further electronic circuit.

Although some aspects have been described in the context of an apparatus, it is obvious that these aspects also represent a description of the corresponding method, such that a block or device of an apparatus also corresponds to a respective method step or a feature of a method step. Analogously, aspects described in the context of a method step also represent a description of a corresponding block or detail or feature of a corresponding apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The research work that has led to these results had been funded by the European Union.

The invention claimed is:

1. Antenna device comprising:

an antenna;

a reflector comprising;

a substrate;

a plurality of reflector structures arranged on or in the substrate and configured to reflect an incident electromagnet wave; and an electronic circuit arranged on or in the substrate and configured to control the antenna;

the antenna device further comprising:

a sub-reflector that is configured to reflect the electromagnetic wave emitted by the antenna at least partly in the direction of the plurality of reflector structures, such that the electromagnetic wave reflected by the sub-reflector is directed in the direction of the plurality of reflector structures and reflected again by the same;

wherein the antenna is connected to the electronic circuit and configured to generate the electromagnetic wave based on a control of the electronic circuit and to emit the same in a direction of the sub-reflector;

wherein the antenna comprises a plurality of antenna elements, wherein a first subset of the antenna elements is configured to generate the electromagnetic wave with a first polarization direction and wherein a second subset of the antenna elements is configured to generate the electromagnetic wave with a second polarization direction;

wherein a first subset of the plurality of reflector structures is configured to reflect the electromagnetic wave with a first degree of reflection when the electromagnetic wave comprises the first polarization direction and to reflect the same with a second degree of reflection when the electromagnetic wave comprises the second polarization, wherein a second subset of the plurality of reflector structures is configured to reflect the electromagnetic wave with a third degree of reflection when the electromagnetic wave comprises the second polarization direction and to reflect the same with a fourth degree of reflection when the electromagnetic wave comprises the first polarization;

wherein the first degree of reflection and the third degree of reflection have a greater value than the second degree of reflection and the fourth degree of reflection.

2. Antenna device according to claim 1, wherein the reflector comprises a radome structure that is arranged with respect to the plurality of reflector structures and configured to at least partly reduce a mechanical or chemical influence of an environment of the plurality of reflector structures on the plurality of reflector structures.

3. Antenna device according to claim 2, wherein the radome structure comprises the subreflector.

4. Antenna device according to claim 2, wherein the substrate comprises a printed circuit board, wherein the printed circuit board comprises a stack with at least a first layer, a second layer and a third layer and wherein the radome structure is formed as radome layer on the substrate.

5. Antenna device according to claim 1, wherein the reflector structures and the sub-reflector comprise a Cassegrain configuration or a Gregorian configuration.

6. Antenna device according to claim 1, wherein the antenna is configured as surface-mounted component.

7. Antenna device according to claim 1, wherein an axial relative position of the sub-reflector with respect to the reflector is variable along an axial direction parallel to a surface normal of the substrate.

8. Antenna device according to claim 1, wherein a lateral relative position of the sub-reflector is variable with respect to the reflector along a lateral direction perpendicular to a surface normal of the substrate or wherein an inclination a of the sub-reflector is variable with respect to a surface of the substrate of the reflector.

9. Antenna device according to claim 1, wherein the antenna is further configured to direct an electromagnetic wave transmitted in the direction of the antenna device and received by the antenna device to the electric circuit or a further electric circuit.

10. Antenna device according to claim 1, comprising a plurality of antennas and a plurality of sub-reflectors, wherein each sub-reflector is allocated to one antenna.

11. Antenna device according to claim 1, wherein the plurality of reflector structures are configured to reflect the incident electromagnetic wave such that the reflected electromagnetic wave experiences beam focusing due to the reflection at the plurality of reflector structures.

12. Antenna device according to claim 1, wherein the substrate comprises a printed circuit board, wherein the printed circuit board comprises a stack with at least a first layer, a second layer and a third layer, wherein the second layer is arranged between the first and the third layer, wherein the plurality of reflector structures are at least partly arranged at, on or in the first layer, and wherein the second layer is at least partly electrically conductive.

13. Antenna device according to claim 12, wherein the second layer is formed as an electric ground plane.

14. Antenna device according to claim 1, wherein the plurality of reflector structures are arranged in at least two differing substrate planes that are arranged parallel to a substrate surface that is arranged facing a direction in which the electromagnetic wave is reflected.

15. Antenna device according to claim 13, wherein at least one partial circuit of the electronic circuit is arranged on a side of the substrate that is facing away from an incident electromagnetic wave impinging on the plurality of reflector structures.

16. Antenna device according to claim 1, wherein at least one reflector structure of the plurality of reflector structures comprises a plurality of dipole structures.

17. Antenna device according to claim 1, further comprising a radom structure arranged with respect to the plurality of reflector structures and configured to at least partly reduce a mechanical or chemical influence of an environment of the plurality of reflector structures on the plurality of reflector structures, wherein the radome structure comprises, at least in areas, an electrically conductive structure or a further plurality of reflector structures that are configured to reflect the electromagnetic wave, wherein the electrically conductive structure or the further plurality of reflector structures are arranged with respect to the plurality of reflector structures such that the electromagnetic wave reflected by the electrically conductive structure is directed in the direction of the plurality of reflector structures and reflected again by the same.

18. Antenna device according to claim 1, wherein the antenna is arranged on or in the substrate, which is connected to the electronic circuit and configured to generate the electromagnetic wave based on a control of the electronic circuit.

* * * * *